US011651744B2

(12) United States Patent
Olchovik

(10) Patent No.: US 11,651,744 B2
(45) Date of Patent: May 16, 2023

(54) SYSTEMS AND METHODS FOR INCREASING BACKLIGHT UNIFORMITY FOR BACKLIT DISPLAY PANELS

(71) Applicant: DELL PRODUCTS L.P., Round Rock, TX (US)

(72) Inventor: Pavel Olchovik, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/501,794

(22) Filed: Oct. 14, 2021

(65) Prior Publication Data

US 2023/0120576 A1 Apr. 20, 2023

(51) Int. Cl.
*G09G 3/34* (2006.01)
*G09G 3/00* (2006.01)

(52) U.S. Cl.
CPC ..... *G09G 3/3426* (2013.01); *G09G 3/006* (2013.01); *G09G 2320/0233* (2013.01); *G09G 2320/0646* (2013.01); *G09G 2360/14* (2013.01); *G09G 2360/16* (2013.01)

(58) Field of Classification Search
CPC ..... G09G 3/006; G09G 3/342–3426; G09G 2320/0233; G09G 2320/0646; G09G 2360/14–148
See application file for complete search history.

(56) References Cited

U.S. PATENT DOCUMENTS

| | | | | |
|---|---|---|---|---|
| 8,670,006 | B2 * | 3/2014 | Hong | G09G 3/3426 345/207 |
| 9,214,111 | B2 * | 12/2015 | Watanabe | G02F 1/1336 |
| 9,372,521 | B2 | 6/2016 | Sultenfuss et al. | |
| 9,558,527 | B2 | 1/2017 | Sierra et al. | |
| 10,997,687 | B1 | 5/2021 | Guerra et al. | |
| 11,289,034 | B2 * | 3/2022 | Koo | G09G 3/3426 |
| 2006/0214904 | A1 * | 9/2006 | Kimura | G09G 3/342 345/102 |
| 2011/0141090 | A1 * | 6/2011 | Hong | G09G 3/3426 345/102 |
| 2015/0269895 | A1 * | 9/2015 | Kao | G09G 3/3426 345/690 |
| 2019/0043423 | A1 * | 2/2019 | Azam | G09G 3/3233 |
| 2020/0279534 | A1 * | 9/2020 | Ji | G09G 3/3648 |
| 2021/0035507 | A1 * | 2/2021 | Koo | G09G 3/3426 |

(Continued)

OTHER PUBLICATIONS

IHS Markit, "Market With Potential Profit and Risks: Demura in the OLED Module Process", Dec. 6, 2019, 5 pgs.

(Continued)

*Primary Examiner* — Gene W Lee
(74) *Attorney, Agent, or Firm* — Egan, Enders & Huston LLP.

(57) ABSTRACT

Systems and methods are provided for using logic-based compensation to optimize luminance uniformity of light emitting diode (LED) backlight panels employed for display panel assemblies such as liquid crystal displays (LCDs). These systems and methods may be implemented using a uniformity profile (e.g., uniformity lookup table "U-LUT") in the LED backlight driving process to provide values to separately control luminance of different backlight segments of a LED backlight panel in order to improve backlight segment luminance uniformity.

24 Claims, 11 Drawing Sheets

(56) References Cited

U.S. PATENT DOCUMENTS

2021/0405404 A1 12/2021 Chang

OTHER PUBLICATIONS

Konica Minolta, "High-Speed, High-Accuracy Color Analyzer That Meets the Measurement Needs of Today's Ever-Evolving Displays", CA-410, Obtained from Internet Sep. 28, 2021, 4 pgs.
Konica Minolta, Radiant Vision Systems, "Mura & Defect Detection With True Test", Obtained from Internet Sep. 28, 2021, 61 pgs.
Wikipedia, "Liquid-Crystal Display", Sep. 14, 2021, 35 pgs.
Radiant Vision Systems, "Mura, Mura on the Wall . . . ", Jun. 25, 2018, 34 pgs.
Radiant Imaging, "Just Noticable Difference Analysis for Display Defect Detection", RrueMURA, 2008, 2 pgs.
Radiant Vision Systems, ProMetric I, Imaging Colorimeter, "The World's Fastest and Most Accurate Hlgh-Resoluton Imaging Colorimeter", 2016, 2 pgs.
Radiant Vision Systems, "Testing for Black Mura Gradient per German Automotive (DFF) Standards", 2018, 4 pgs.
Radiant Vision Systems, White Paper, "How to Use Imaging Colorimeters to Improved OLED Display Production Efficiency and Yields", 2018, 11 pgs.
Radiant Vision Systems, White Paper, "Methods for Measuring Display Defects and Mura as Correlated to Human Visual Perception", 2017, 9 pgs.
Radiant Vision Systems, "Truetest Overview", Mar. 2016, 52 pgs.

* cited by examiner

183

| | | | | |
|---|---|---|---|---|
| 504 1<br>**1,1** | 504 2<br>**2,1** | 504 3<br>**3,1** | 504 4<br>**4,1** | 504 5<br>**5,1** |
| 504 6<br>**1,2** | 504 7<br>**2,2** | 504 8<br>**3,2** | 504 9<br>**4,2** | 504 10<br>**5,2** |
| 504 11<br>**1,3** | 504 12<br>**2,3** | 504 13<br>**3,3** | 504 14<br>**4,3** | 504 15<br>**5,3** |
| 504 16<br>**1,4** | 504 17<br>**2,4** | 504 18<br>**3,4** | 504 19<br>**4,4** | 504 20<br>**5,4** |
| 504 21<br>**1,5** | 504 22<br>**2,5** | 504 23<br>**3,5** | 504 24<br>**4,5** | 504 25<br>**5,5** |

*FIG. 5A*

183

| | | | | |
|---|---|---|---|---|
| 504 1<br>**0.92** | 504 2<br>**0.95** | 504 3<br>**1.0** | 504 4<br>**0.97** | 504 5<br>**0.93** |
| 504 6<br>**1.2** | 504 7<br>**0.93** | 504 8<br>**0.97** | 504 9<br>**1.4** | 504 10<br>**0.95** |
| 504 11<br>**0.91** | 504 12<br>**1.1** | 504 13<br>**1.3** | 504 14<br>**0.97** | 504 15<br>**0.99** |
| 504 16<br>**1.2** | 504 17<br>**1.3** | 504 18<br>**0.98** | 504 19<br>**1.0** | 504 20<br>**0.91** |
| 504 21<br>**0.99** | 504 22<br>**1.2** | 504 23<br>**0.96** | 504 24<br>**0.94** | 504 25<br>**1.1** |

*FIG. 5B*

SYSTEMS AND METHODS FOR INCREASING BACKLIGHT UNIFORMITY FOR BACKLIT DISPLAY PANELS

FIELD OF THE INVENTION

This application relates to information handling systems and, more particularly, to operation of backlights for display panels of information handling systems.

BACKGROUND

As the value and use of information continues to increase, individuals and businesses seek additional ways to process and store information. One option available to human users is information handling systems. An information handling system generally processes, compiles, stores, and/or communicates information or data for business, personal, or other purposes thereby allowing human users to take advantage of the value of the information. Because technology and information handling needs and requirements vary between different human users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific human user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Globally dimming liquid crystal displays (LCDs) are illuminated by a backlight area under the LCD panel, and use global dimming that is driven by a row of light emitting diodes (LEDs) that is separate from the backlight area and located on the edge of the display. In a globally dimming LCD, the entire backlight luminance area is controlled with one brightness control value.

Local dimming LCDs employ a two-dimensional array of LEDs that are distributed over the backlight luminance area in a panel positioned under a separate liquid crystal panel to illuminate the separate liquid crystal panel (LCD display panel). LEDs in the local dimming LCD backlight array are divided into individually driven groups or segments. Using content-adaptive backlight control, the brightness of each backlight segment is adjusted according to different display content to allow the display to have "darker blacks" and "brighter whites". In this regard, LCD display panels have inherent light leakage which limit how dark they reproduce the desired blacks. LCD display panel content that has very bright and dark display content in the same frame is partitioned into the corresponding LED backlight segments. The LED backlight in each segment is individually tailored for the corresponding LCD display panel content it supports or illuminates. In high luminance LCD display panel content areas, the corresponding LED backlight segment luminance is increased to be brighter and to produce "brighter whites". In lower luminance LCD display panel content areas, the corresponding LED backlight segment luminance is reduced, so that the light leakage in those areas are proportionately reduced to produce a "blacker black".

In response to image content data provided by a graphics processing unit, a timing controller (Tcon) of a LCD display panel assembly executes a dual modulation algorithm to simultaneously produce a luminance data stream signal and an image modulation data stream signal. The luminance data stream signal is provided to a backlight controller of the LCD display panel assembly to cause the backlight controller to independently drive the brightness or luminance level for each LED backlight segment of the LCD display panel. The image modulation data stream signal is provided to a LCD panel of the LCD display panel assembly to independently vary the displayed image content of each pixel of a LCD display panel assembly.

Intrinsic variation in the LED manufacturing process creates differences in the luminance of individual LED backlight elements at the same driving voltage and current. This variation in the LED backlight luminance is easily detected by human vision as a non-uniform brightness (like a checkerboard pattern). After optimization of layout current resistance loss (IR) parameters, there are still large variations of individual LED luminance due to manufacturing tolerances of the forward LED voltage (Vf) and other factors such as backlight driver variations. This creates non-uniformity in the LCD luminance performance. Currently, hardware assembly methods (i.e., sorting, binning and mixing of individual LED backlight elements during backlight panel assembly) are employed in an attempt to address non-uniform LED backlight panel luminance. These methods partially improve the backlight luminance uniformity but do not mitigate all of the LED backlight luminance difference, which is still visible when a LCD displays certain patterns. For example, variation in LED backlight element luminance for the same driving conditions are measured in production and the individual LED backlight elements are placed into separate "bins" depending on the measured luminance of each individual LED backlight element. Each bin has a range of LED backlight element luminance values (i.e., bin tolerance), so that a luminance difference is visible between the lowest and the highest LED bin values. Binning also creates additional manufacturing complexity, increases costs and has greater sensitivity to market availability.

Organic light emitting diode (OLED) pixel-level demura is a manufacturing process known to address non-uniformity in the luminance of individual pixel content display of a OLED display due to OLED production variation. This OLED pixel-level demura is performed on a pixel-level basis during OLED display manufacture for individual OLEDs of OLED displays, which do not employ backlighting or a separate backlight panel. Using pixel-level demura, a permanent correction value is applied during OLED display manufacture to each individual OLED pixel of an assembled OLED display to individually vary the displayed luminance of each individual OLED pixel of the OLED display so as to increase luminance uniformity of the OLED display.

SUMMARY OF THE INVENTION

Systems and methods are disclosed herein for using logic-based compensation to optimize luminance uniformity of light emitting diode (LED) backlight panels employed for display panel assemblies such as liquid crystal displays (LCDs). In one embodiment, the disclosed systems and methods may be so implemented in a relatively simple and low cast manner to compensate for variations of individual LED backlight segment luminance that exist due to factors such as manufacturing tolerances of the forward LED voltage (Vf) of individual LED elements within the LED backlight segments of a LED backlight panel.

In one embodiment, the disclosed systems and methods may be implemented using a uniformity profile (e.g., uniformity lookup table "U-LUT") in the LED backlight driving process to provide values to separately control luminance of different backlight segments of a LED backlight panel of a LCD display panel assembly in order to improve backlight segment luminance uniformity. In one embodiment, product updates and dynamic modification to a uniformity profile may be implemented (e.g., downloaded and installed to non-volatile memory of a display panel timing controller) after deployment of a display panel assembly in the field. In one embodiment, an end user may be allowed to reprogram the LED backlight segment control by using different uniformity profiles. For example, a basic uniformity profile may be initially provided during manufacturing to compensate for the luminance variation that normally occurs during the LED element aging process, while a variety of parameters (e.g., such as bin tolerance) for creation of different uniformity profiles may be developed depending on the end user needs.

In one embodiment, the disclosed systems and methods may be implemented to increase backlight zone luminance uniformity for display panel assemblies such as LCD display panel assemblies that employ multiple separate light emitting diode (LED) backlight segments (i.e., with each segment including one or more LED backlight elements) configured in a two-dimensional backlight array for display panel illumination. In one embodiment, the disclosed systems and methods may be implemented during display panel assembly operation using logic-based (e.g., software and/or firmware algorithm) compensation in the backlight signal driving levels that are provided to each LED backlight segment in order to compensate for luminance variation between different LED backlight segments.

In one embodiment, backlight luminance compensation logic may be utilized in combination with one or more uniformity profiles (e.g., lookup tables) to perform dynamic digital transformation of backlight brightness or luminance levels in real time for separate LED backlight segments of a display panel assembly. This is in contrast to only using the selection of LED hardware components that is conventionally employed during the manufacture of LED backlight panels. The backlight luminance compensation logic may be executed, for example, by a dual modulation logic software of firmware algorithm executed by a programmable integrated circuit of a display timing controller (Tcon), or may be alternatively executed as separate uniformity compensation logic by a programmable integrated circuit of a LED backlight controller for a display panel assembly. In the latter case, performing uniformity compensation in a LED backlight controller separates it from the Tcon's other functions, and therefore may reduce complexity. Further, performing uniformity compensation in a LED backlight controller may allow a segmented LED backlight panel and LED backlight controller to be tested and programmed for luminance uniformity as a separate unit from remaining portions of an LCD display panel assembly and its integrated Tcon.

In one embodiment, a luminance measuring device (e.g., such as a photocolorimeter) may be used (e.g., during manufacture of a LCD display panel assembly) to measure and capture the individual luminance variation (or error) of each separate LED backlight segment (e.g., measured relative to the mean of the expected luminance value) in a lighted two-dimensional backlight array of a LCD display panel assembly. In this regard, a luminance variation between different LED backlight segments may result, for example, from luminance differences between individual LEDs that occur due to initial producing differences between individual LEDs, e.g., due to LED manufacturing tolerances that allow for some variation in luminance intensity between different produced LEDs. During luminance measurement, the luminance measuring device (e.g., such as a photocolorimeter) may be operated to automatically integrate the combined luminance of multiple individual LED elements present in a single LED backlight segment that is driven by a common backlight driver circuit of a backlight controller. After measurement of the luminance variation of each separate LED backlight segment of the LCD display panel assembly (e.g., relative to the mean of the expected luminance value), the calculated inverse of the measured luminance variation of each separate LED backlight segment may then be stored in a uniformity lookup table (U-LUT) as a respective U-LUT offset value.

Because the rate of luminance variation of individual LEDs changes with applied power level, luminance variation between separate LED backlight segments of a LCD display panel assembly may be optionally made using the luminance measuring device at multiple different applied LED power levels in order to accommodate for a difference in the luminance variation exhibited between the same given LED backlight segments that occurs at different LED power levels. An optimum U-LUT offset value may then be calculated for each given LED backlight segment from the different measured LED luminance variation values for that given LED backlight segment. For example, assuming that a given LED backlight segment measured at the original drive level is two units lower in luminance than the expected value, a U-LUT offset value may be calculated that modifies the driving signal data for that given LED backlight segment by adding two units of luminance so that the resulting driven LED backlight segment is increased to the intended luminance by adding the two units of luminance.

In one embodiment, the calculated U-LUT offset value for each given LED backlight segment may be applied using software and/or firmware logic (e.g., that is executing on a timing controller and/or backlight controller of the display panel assembly) to modify the respective LED driver command data value that is provided to drive the given LED backlight segment luminance level in order to offset a previously-measured luminance error and remove observable backlight segment luminance differences via compensation of individual backlight segment luminance across the digital input range. When so applied, each U-LUT offset value acts to modify a given LED backlight segment command data value provided to a corresponding given LED backlight segment of a LCD display panel assembly in a manner that counters (i.e., reduces or eliminates) the luminance variation (or luminance error) of the corresponding given LED backlight segment. Using the disclosed systems and methods, the LED backlight segment command data value provided to each LED backlight segment of a LCD display panel assembly may be modified using a corresponding U-LUT offset value to cause the LCD display panel assembly to generate a displayed image that has a greater luminance uniformity across the different LED backlight segments of the LCD display panel assembly than would otherwise exist without application of the U-LUT offset values to modify the LED driver command data values in the above-described manner.

In one embodiment, the U-LUT offset values may be so applied in a self-contained and autonomous manner by one or more programmable integrated circuits executing logic within the LCD display panel assembly. In one embodiment, the U-LUT offset values may be stored within non-volatile memory of a LCD display panel assembly, and may be later updated one or more times as needed, e.g., by software and/or firmware product updates that are later downloaded to the display panel assembly. In one embodiment, U-LUT offset values may be applied to control LED backlight segments independently from panel/backlight dual modulation and in a manner that does not affect the local dimming dual modulation operation.

In one respect, disclosed herein is a method, including: providing image content data to a display panel assembly, the display panel assembly including a display panel and a backlight panel that includes multiple backlight elements illuminating the display panel; responding to receipt of the image content data in the display panel assembly by producing image data and backlight luminance data from the image content data; modifying the backlight luminance data using at least one correction factor to produce a modified backlight luminance data; simultaneously providing the image data to the display panel and providing the modified backlight luminance data to the backlight panel; and generating an image on the display panel from the image data while at the same time using the modified backlight luminance data to control a luminance level of light emitted to the display panel from each of the backlight elements.

In another respect, disclosed herein is a system, comprising: a display panel assembly including a display panel, a backlight panel that includes multiple backlight elements illuminating the display panel, and at least one first programmable integrated circuit programmed to receive image content data. The at least one first programmable integrated circuit of the display panel assembly may be programmed to: respond to receipt of the image content data by producing image data and backlight luminance data from the image content data, modify the backlight luminance data using at least one correction factor to produce modified backlight luminance data, simultaneously provide the image data to the display panel and provide the modified backlight luminance data to the backlight panel; and generate an image on the display panel from the image data while at the same time using the modified backlight luminance data to control a luminance level of light emitted to the display panel from each of the backlight elements.

In another respect, disclosed herein is a method, including: measuring luminance performance data of a displayed image of a display panel assembly, the display panel assembly including a display panel generating the image and a backlight panel that includes multiple backlight elements illuminating the displayed image on the display panel; using the measured luminance performance data to determine at least one correction factor for modifying luminance of the multiple backlight elements of the display panel assembly during operation of the display panel assembly; and writing the determined at least one correction factor to non-volatile memory of the display panel assembly.

BRIEF DESCRIPTION OF THE DRAWINGS

FIG. 5A illustrates a matrix of array coordinates for a uniformity lookup table (U-LUT) according to one exemplary embodiment of the disclosed systems and methods.

FIG. 5B illustrates an exemplary offset value data format for a U-LUT matrix according to one exemplary embodiment of the disclosed systems and methods.

DESCRIPTION OF ILLUSTRATIVE EMBODIMENTS

Figure 1:
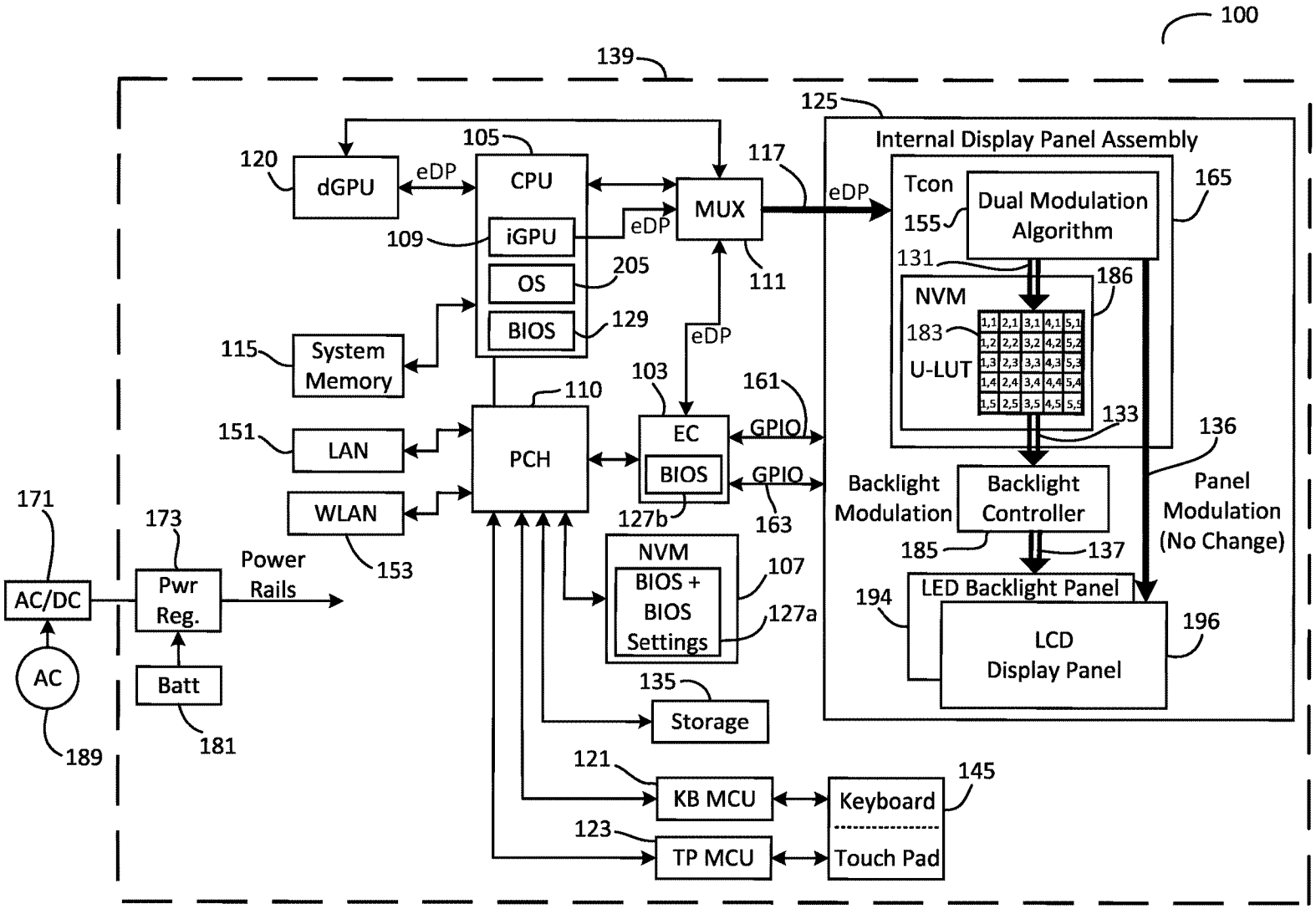
FIG. 1 illustrates a block diagram of an information handling system according to one exemplary embodiment of the disclosed systems and methods.

FIG. 1 is a block diagram of an information handling system 100 as it may be configured according to one exemplary embodiment of the disclosed systems and methods. Information handling system 100 may be, for example, a mobile or portable information handling system such as a notebook computer, laptop computer, or tablet computer having a chassis enclosure 139 which may be, for example, a plastic and/or metal case (e.g., notebook computer case, tablet computer case, smartphone case, etc.) that encloses and contains the illustrated components of system 100. However, in other embodiments (e.g., such as a desktop or tower computer embodiment), one or more components of information handling system 100 (e.g., such as a display panel assembly described further herein) may be separate components that are positioned external to chassis enclosure 139 and coupled in signal communication with internal components of system 100 (e.g., such as a host programmable integrated circuit 105 described further herein).

Still referring to FIG. 1, information handling system includes host programmable integrated circuit 105 which may be a central processing unit CPU such as an Intel processor, Advanced Micro Devices (AMD) processor, or one of many other suitable programmable integrated circuits currently available. In this embodiment, a host programmable integrated circuit in the form of CPU 105 may execute a host operating system (OS) 205 and system BIOS 129 for system 100. System memory may include main system memory 115 (e.g., volatile random access memory such as DRAM or other suitable form of random access memory) coupled (e.g., via DDR channel) to an integrated memory controller (iMC) of CPU 105 to facilitate memory functions, although it will be understood that a memory controller may be alternatively provided as a separate chip or other circuit in other embodiments.

As shown in FIG. 1, CPU 105 itself includes an integrated graphics processing unit (iGPU) 109 and information handling system 100 may also include an optional separate internal discrete graphics processing unit (dGPU) 120 such as a graphics card that is powered by a power source of information handling system (e.g., such as AC adapter 171 and/or internal smart battery pack 181) using internal integrated power supply circuitry and/or internal voltage regulation circuitry 173 of information handling system 100. Examples of different dGPU manufactures and suppliers include, but are not limited to, Nvidia, AMD, etc. Examples of different types of dGPUs include, but are not limited to, Nvidia Quadro, Nvidia Geforce, AMD Radeon, AMD RX, etc.

As further shown in FIG. 1, iGPU 109 of CPU 105 and dGPU 120 may each be coupled to provide data that contains frames of image content (e.g., video image content) via an audio/visual interface (e.g., such as a multi-channel Embedded DisplayPort "eDP" bus) to a multiplexer (MUX) 111. The image content may be, for example, standard definition resolution (SDR) image content, high definition resolution (HDR) image content, etc. Multiplexer 111 may in turn be coupled to selectively provide frames of image content data 117 (e.g., via an eDP bus) from either iGPU 109 or dGPU 105 to a timing controller (Tcon) 165 of liquid crystal display (LCD) display panel assembly 125 (e.g., which may be an integrated display assembly in embodiments where information handling system 100 is a notebook computer or other mobile or portable information handling system). In a further embodiment, a system embedded controller (EC) 103 may additionally or alternatively provide data that contains frames of image content (e.g., via MUX 111).

Tcon 165 may be a programmable integrated circuit (e.g., such as microcontroller) that executes a dual modulation logic 155 with a look up table (U-LUT) 183 that is stored on non-volatile memory (NVM) 186 of Tcon 165 and that is described further herein. NVM 186 may also store other information such as programming, system variables and display port configuration data (DPCD) registers for use by Tcon 165 during operation. As further shown, Tcon 165 is in turn coupled as shown to use the U-LUT to convert the received image content data format to backlight modulation signals 133 that are provided to a backlight controller 185 (e.g., which may include a programmable integrated circuit such as a microcontroller) which responds by generating corresponding backlight driver signals 137 for controlling luminance (or brightness) levels of LED backlight panel 194 to illuminate LCD display panel 196, e.g., which may have a resolution of 1920 pixels×1080 pixels, 3840 pixels×2160 pixels or other greater or lesser resolution. Tcon 165 also converts the received image content data to image modulation data stream signals 136 that are provided directly to LCD display panel 196 for controlling generation of images for display by LCD display panel 196.

It will be understood that eDP is just one example of a suitable type of data bus interface that may be employed to route graphics data between internal components of information handling system 100, and that any other suitable type of data bus/es may be employed. Other examples of possible dGPU and/or iGPU configurations and system architectures may be found described and illustrated in U.S. patent application Ser. No. 16/916,970 filed Jun. 30, 2020, in U.S. Pat. No. 9,558,527, and in U.S. Pat. No. 10,997,687, each of which is incorporated herein by reference in its entirety for all purposes.

In one optional embodiment, image content from CPU 105 may be sourced at any given time either by iGPU 109 or dGPU 120, and may be switchable "on the fly" by multiplexer (MUX) 111 from one to the other, e.g., using drivers of a switchable graphics software utility (e.g., NVidia Optimus available from NVidia of Santa Clara, Calif.; AMD Power Express available from Advanced Micro Devices Inc. of Sunnyvale, Calif.) that may be executing on CPU 105 and that is typically provided by a supplier of the given dGPU 120 that is presently installed in information handling system 100.

As further illustrated in FIG. 1, CPU 105 may be coupled to platform controller hub (PCH) 110 (e.g., by direct media interface "DMI") which may be present to facilitate input/output functions for the CPU 105 with various internal components of information handling system 100. Illustrated examples of other such components include system embedded controller (EC) 103 (e.g., coupled to PCH 110 via low pin count "LPC" connection and in this embodiment also coupled to display panel 125 to exchange GPIO signal/s on GPIO conductors 161 and 163), non-volatile memory (NVM) 107 (e.g., SPI Flash memory device and/or other NVM devices), wireless network controller 153 for wireless local area network (WLAN) or other wireless network communication, integrated network interface card 151 for Ethernet local area network (LAN) or other wired network connection, touchpad microcontroller (MCU) 123, and keyboard microcontroller (MCU) 121. Also shown coupled to PCH 110 are other components of information handling system 100 which include integrated keyboard and touchpad 145 (which may alternatively be present as separate discrete keyboard and touchpad components), and local system storage 135, e.g., hard drive or other suitable type of permanent storage media such as solid state drive (SSD), optical drives, NVRAM, Flash or any other suitable form of internal storage. Persistent storage (e.g., non-volatile memory 107) may be accessed as needed by EC 103 and/or CPU 105. Such persistent storage 107 may store or contain firmware or other programming (e.g., such as BIOS code and BIOS settings 127*a*) that may be used by host programmable integrated circuit 105 and/or EC 103 (e.g., shown in FIG. 1 executing EC BIOS code 127*b*).

In one embodiment, information handling system 100 may be a mobile battery-powered information handling system having power supply circuitry and/or internal voltage regulation circuitry 173 that provides power to power-consuming components of system 100 via power rails, and that may be selectively coupled to an external source of system (DC) power, for example AC mains 189 and an AC adapter 171. Information handling system may also include an internal DC power source (e.g., smart battery pack) 181 that is configured to provide system power source for the system load of information handling system, e.g., when an external source of system power is not available or not desirable. Further information on battery-powered information handling system architecture and components may be found in U.S. Pat. No. 9,372,521, which is incorporated herein by reference in its entirety. It will also be understood that the particular configuration of FIG. 1 is exemplary only, and that an information handling system may be configured with fewer, additional or alternative components than those illustrated in FIG. 1.

Figure 2:
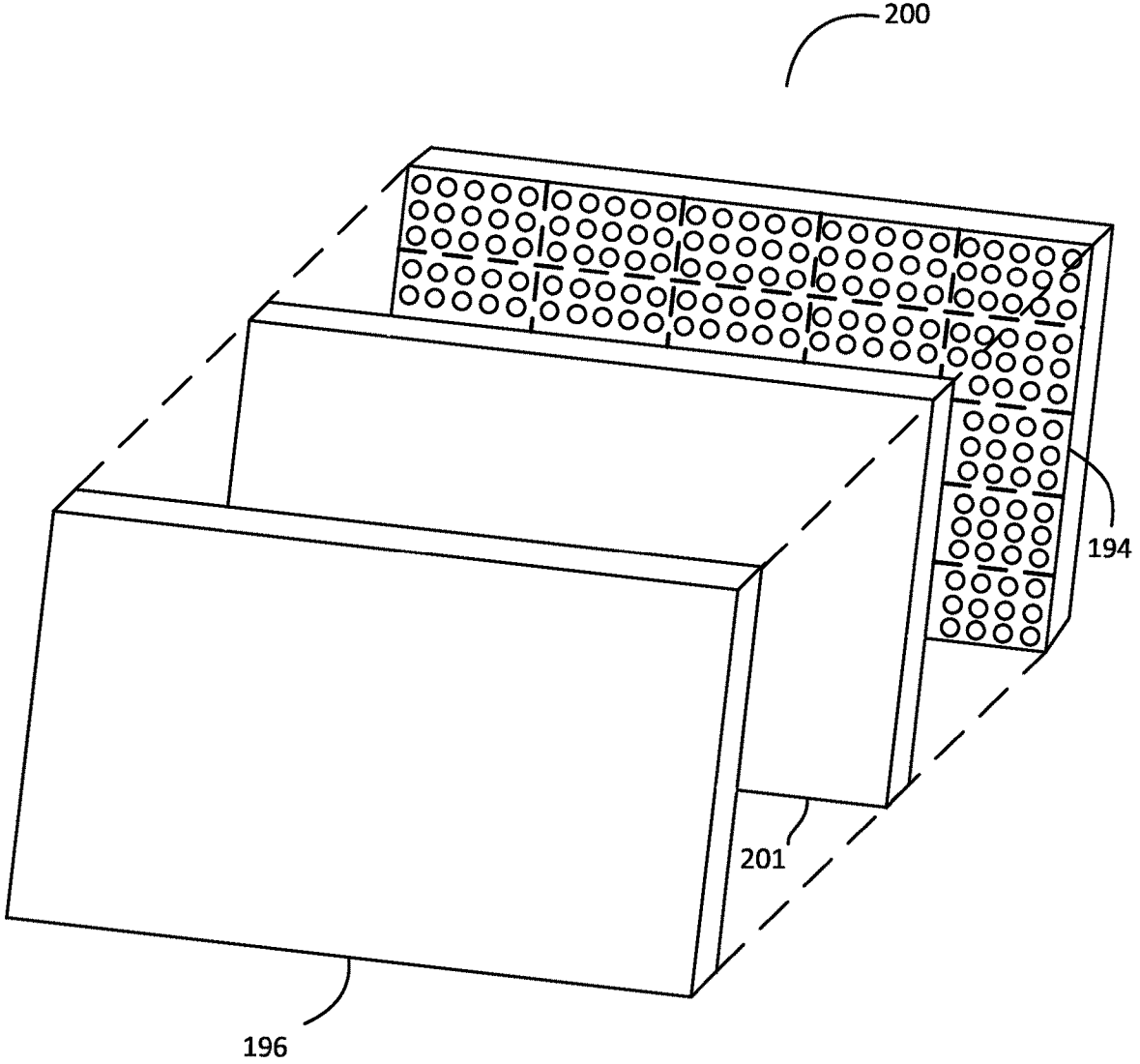
FIG. 2 an exploded view of components of LCD display panel assembly according to one exemplary embodiment of the disclosed systems and methods.

FIG. 2 illustrates an exploded view of components of LCD display panel assembly 125 that include a full array segmented local dimming LED backlight panel 194 positioned for assembly to LCD display panel cell 196 around intervening panel/s 201 (e.g., that may include light guide plate, color conversion, and diffusion films). In one embodiment, LCD display panel 196 may include a layer of nematic liquid crystals disposed between two electrode layers and between two polarizing filter films (e.g., vertical and horizontal polarizing films). In such an embodiment, images may be produced or generated on the LCD display panel 196 by controlling the voltage applied across the liquid crystal layer in each given pixel location of the multiple pixel locations of the LCD display panel 196, which in turn controls light modulation induced by the liquid crystal layer at that given pixel location. Light modulation may be separately controlled at the multiple different pixel locations of the LCD display panel 196 to produce an image when light travels through the liquid crystal layer and the two surrounding polarizing filter films. Since LCD display panel 196 does not itself emit light, LED backlight panel 194 is present to provide the necessary light from the back of LCD display panel 196 to illuminate the produced image for display on the front of LCD panel 196 to a user.

Figure 3:
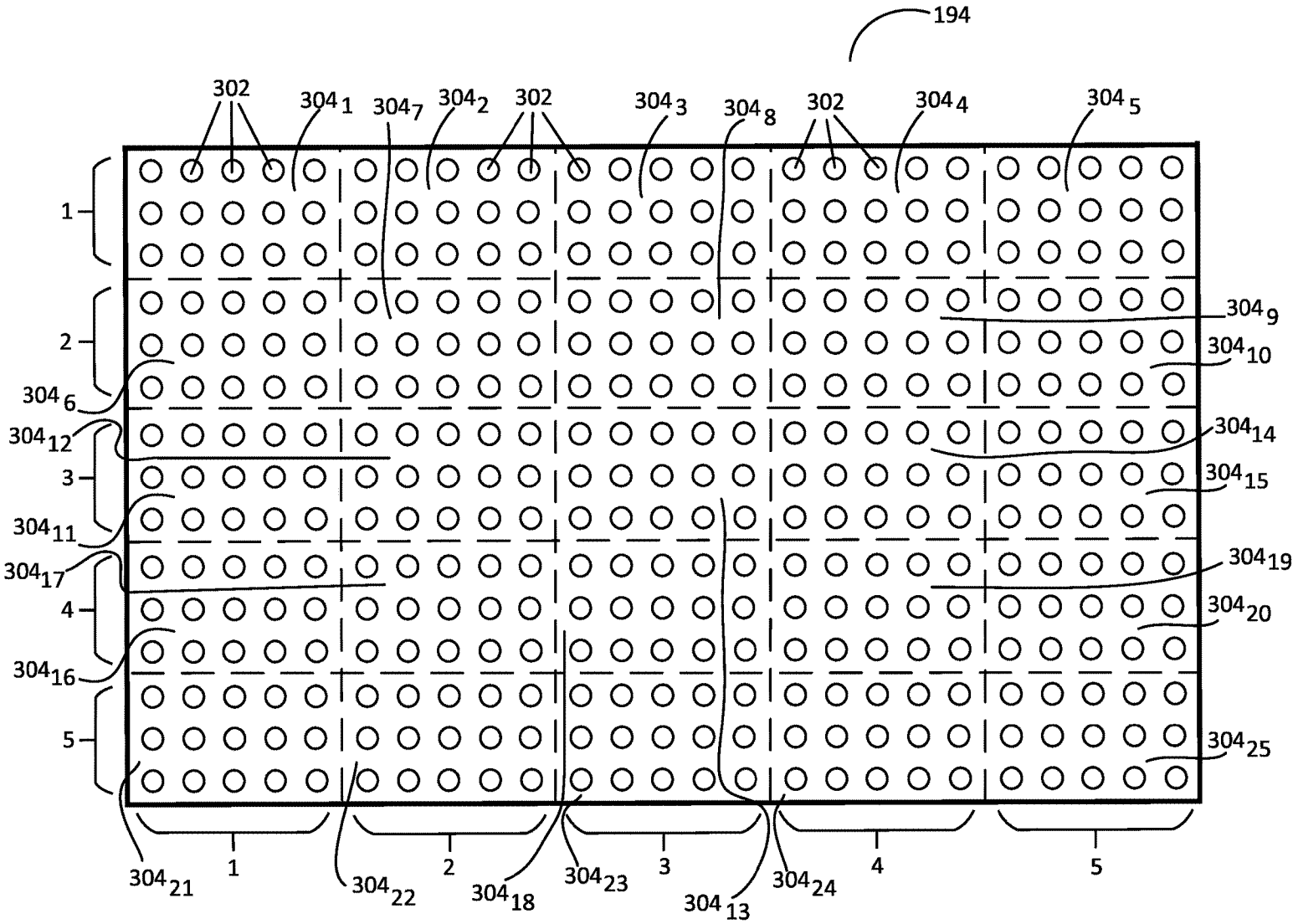
FIG. 3 illustrates a frontal view of a segmented backplane of a LED backlight panel according to one exemplary embodiment of the disclosed systems and methods.

FIG. 3 illustrates a frontal view of a segmented backplane of LED backlight panel 194 which includes a two-dimensional (2D) array of individual LED elements 302 (i.e., individual LEDs 302) that are segmented into multiple backlight segments $\mathbf{304}_1$ to $\mathbf{304}_{25}$ by columns 1-5 and rows 1-5 as shown. As further shown, a different LED backlight segment 304 (including a corresponding portion of the LED elements 302) is formed at each intersection of a column and row of LED backlight panel 194. It will be understood that the illustrated number of columns and rows (and the number LED backlight elements in each segment) in FIG. 3 are exemplary only, and that a segmented backplane of a LED backlight panel may include more than 25 different backlight segments or may include less than 25 backlight segments in other embodiments. Additionally, a segmented backplane of a LED backlight panel may include greater or lesser numbers of rows and/or columns than are shown FIG. 3, and/or may include a greater or lesser number of backlight elements disposed in each segment than is shown in FIG. 3.

Figure 4:
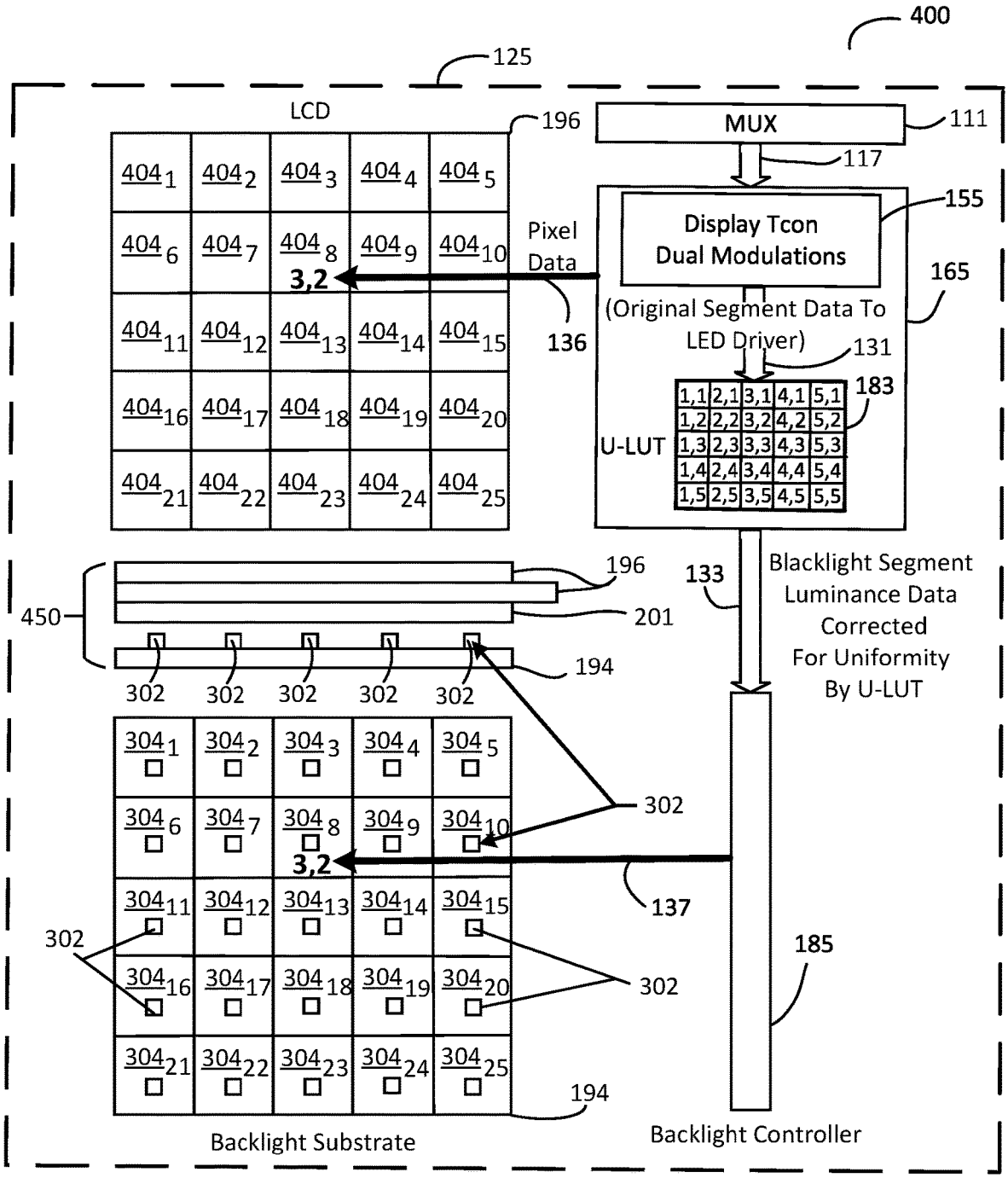
FIG. 4 illustrates a data flow and processing for a LCD display panel assembly according to one exemplary embodiment of the disclosed systems and methods.

FIG. 4 illustrates data flow and processing 400 for LCD display panel assembly 125 according to one exemplary embodiment of the disclosed systems and methods. As shown in FIG. 4, LCD display panel cell 196 is mapped with segmented LCD areas 404, each of which displays image content and each of which is aligned with a corresponding one of the LED backlight segments 304 of LED backlight panel 194 when LED backlight panel 194 is assembled to LCD display panel cell 196 around an intervening diffusion panel 201 as shown in FIG. 2. Diffusion panel 201 in turn distributes light from each LED backlight segment 304 to its corresponding LCD segment area 404. When so assembled, LCD segment $\mathbf{404}_1$ aligns with (and its displayed image content is selectively illuminated by) LED backlight segment $\mathbf{304}_1$, LCD segment $\mathbf{404}_2$ aligns with and is selectively illuminated by LED backlight segment $\mathbf{304}_2$, LCD segment $\mathbf{404}_3$ aligns with and is selectively illuminated by LED backlight segment $\mathbf{304}_3$, etc.

In FIG. 4, an edge view 450 of these assembled components of LCD display panel assembly 125 is also shown in a superimposed inset to show interrelation of the illustrated components. For purposes of illustration in FIG. 4, each backlight segment 304 is shown having a single LED backlight element 302, although it will be understood that each backlight segment may include more than a single LED backlight element 302, and that the number of LED backlight segments 304 and their corresponding LCD segment areas 404 may also vary.

Still referring to FIG. 4, Tcon 165 receives image content frames in image content data stream 117 from MUX 111. Based on this received image content stream data 117, Tcon 165 executes a dual modulation logic 155 to simultaneously provide image modulation data stream signal 136 for each image frame (that includes the unchanged correct transmitted light level specified by image content data 117 for each pixel in each given one of the LCD segment areas 404) to LCD display panel cell 196, while at the same time generating and providing modified backlight modulation data stream signal 133 for each image frame (that provides a respective modified LED backlight segment brightness value for the LED backlight segment 304 that corresponds to each given one of the LCD segment areas 404) to the backlight controller 185. For example, as shown in FIG. 4 LCD segment area $\mathbf{404}_8$ corresponds to (and is physically aligned with) LED backlight segment $\mathbf{304}_8$, and each are designated by array coordinates "3,2".

In one embodiment, the display panel data modulation 136 (going to LCD display panel 196) is adjusted to get the intended luminance based on the modified backlight segment luminance. The brightest pixel in the backlight zone (e.g. such as $\mathbf{404}_8$) determines the maximum luminance of the that zone. If that is a reduction of say 50%, then each of the pixels over zone $\mathbf{404}_8$ are driven higher to let 50% more light through which results in the original luminance level of the overall system.

To increase backlight zone luminance uniformity, Tcon 165 of FIG. 4 modifies the original segment luminance data stream signal 131 for each given LED backlight segment 304 (to modify the brightness of the given LED backlight segment 304) according to a corresponding respective U-LUT offset value that is defined in a U-LUT 183 for the given LED backlight segment 304, before then sending the modified or corrected backlight segment luminance data stream signal 133 for the given LED backlight segment in the modified backlight modulation data stream signals 133 to backlight controller 185. Backlight controller 185 responds by generating backlight driver signals 137 corresponding to the respective modified backlight modulation data stream signals 133 to control brightness levels of each LED backlight segment 304 of LED backlight panel 194 in order to illuminate LCD display panel 196 with increased backlight luminance uniformity over the unmodified segment luminance data.

FIG. 5A illustrates an exemplary embodiment of a matrix of array coordinates for a U-LUT 183, in which each entry or segment 504 of the U-LUT matrix may contain a respective offset value assigned to a corresponding backlight segment 304 of LED backlight panel 194, i.e., U-LUT matrix segment $\mathbf{504}_1$ corresponds to LED backlight segment $\mathbf{304}_1$, U-LUT matrix segment $\mathbf{504}_2$ corresponds to LED backlight segment $\mathbf{304}_2$, U-LUT matrix segment $\mathbf{504}_3$ corresponds to LED backlight segment $\mathbf{304}_3$, etc.. As described herein, the original value of each segment luminance modulation data stream signal 131 is modified by application of an offset value of U-LUT 183 to produce a modified value of a respective LED modulation data stream signal 133.

FIG. 5B illustrates an exemplary offset value data format for the U-LUT matrix embodiment of FIG. 5A, in which a hypothetical scale factor is assigned to each respective matrix segment 504 of the U-LUT 183 for use by the Tcon 165 to modify the brightness level of the corresponding LED backlight segment 304. For example, the raw segment luminance modulation data stream signal 131 for LED backlight segment $\mathbf{304}_1$ is multiplied by the 0.92 scale factor of U-LUT matrix segment $\mathbf{504}_1$ to produce the corresponding modified LED backlight modulation data stream signal 133 for LED backlight segment $\mathbf{304}_1$, the raw segment luminance modulation data stream signal 131 for LED backlight segment $\mathbf{304}_2$ is multiplied by the 0.95 scale factor of U-LUT matrix segment $\mathbf{504}_2$ to produce the corresponding modified LED backlight modulation data stream signal 133 for LED backlight segment $\mathbf{304}_2$, the raw segment luminance modulation data stream signal 131 for LED backlight segment $\mathbf{304}_3$ is multiplied by the 1.0 scale factor of U-LUT matrix segment $504_3$ to produce the corresponding modified LED backlight modulation data stream signal 133 for LED backlight segment $304_3$, etc. However, it will be understood that any other suitable data format for listing (or assigning) and applying respective offset values for individual LED backlight segments 304 to increase luminance (or brightness) uniformity of a LED backlight panel 194 may be alternatively employed.

Figure 6:
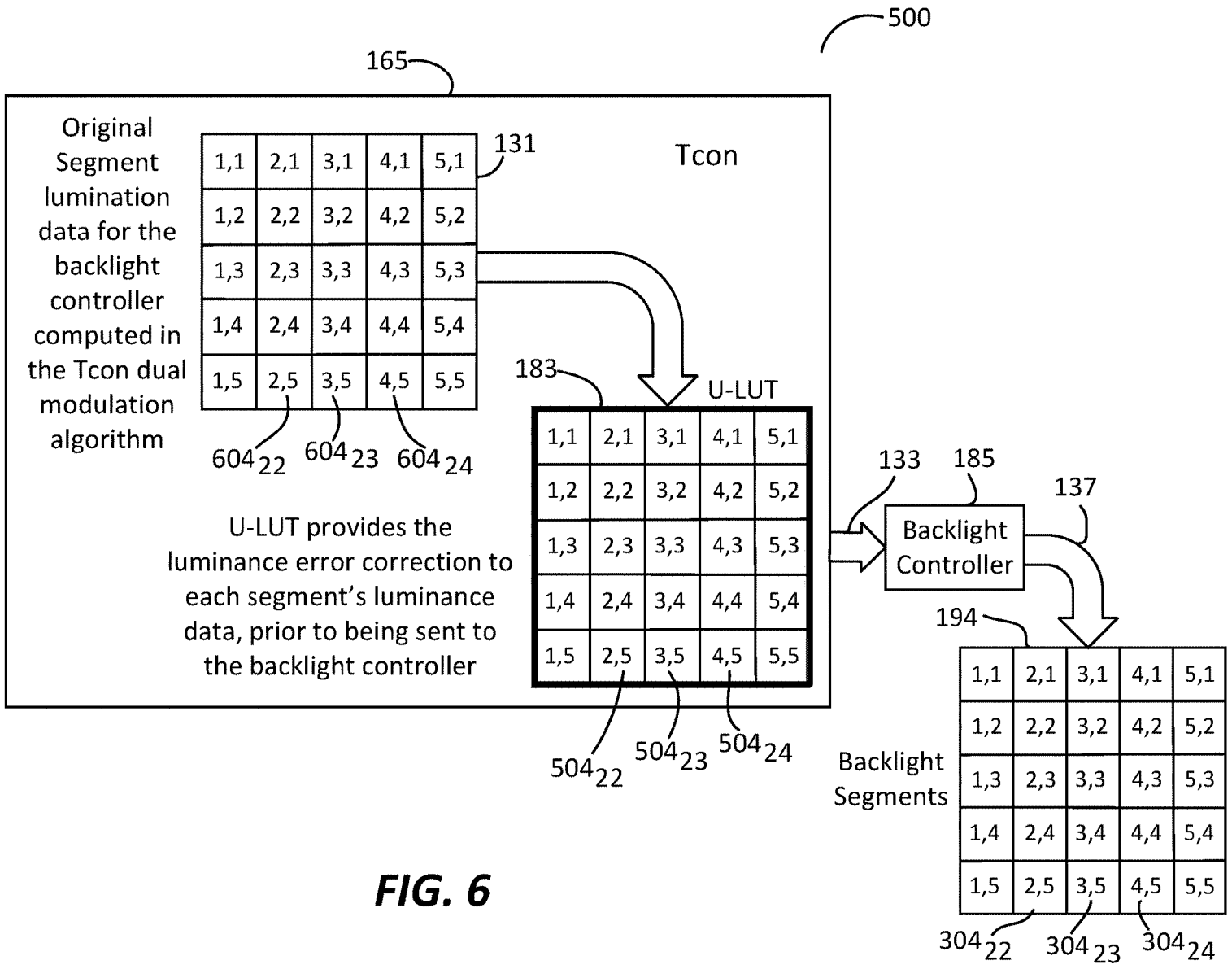
FIG. 6 illustrates a data flow according to one exemplary embodiment of the disclosed systems and methods.

FIG. 6 illustrates one exemplary embodiment of data flow from Tcon 165 through backlight controller 185 to individual LED backlight segments 304 of LED backlight panel 194. During operation, an original luminance data stream value (e.g., SDR, HDR, etc.) is dynamically produced by Tcon dual modulation logic 155 for every image frame. The original luminance data stream value for each segment is modified in real time (on a frame by frame basis) by the corresponding offset value in the U-LUT 183 before being sent to the backlight controller 185. In one embodiment, the U-LUT may be by-passed in response to a command received from a system control pin (I/O) if desired, e.g., such as when a third party application provides its own luminance modifications or corrections in a different look up table (LUT).

Using the example U-LUT matrix embodiment of FIG. 5B for illustration, the original luminance data stream value for each respective segment 604 of original segment luminance data stream signal 131 that is produced by dual modulation logic 155 is multiplied by the scale factor assigned to the corresponding matrix segment 504 of the U-LUT 183 to produce the modified backlight modulation data stream value of data stream signal 133 to be used by backlight controller 185 to drive the brightness of the corresponding LED backlight segment 304 of LED backlight panel 194, e.g., original data stream value $604_{22}$ of each image frame is multiplied by the assigned scale factor of 1.2 for driving LED segment $304_{22}$, original data stream value $604_{23}$ of each image frame is multiplied by the assigned scale factor of 0.96 for driving LED segment $304_{23}$, original data stream value $604_{24}$ of each image stream is multiplied by the scale factor of 0.94 for driving LED segment $304_{24}$, etc.

In one embodiment, the disclosed systems and methods may be further implemented to increase the luminance uniformity across a segmented two-dimensional LED backlight panel 194 by smoothing out luminance transitions across boundaries between adjacent LED backlight segments 304 that exhibit different unadjusted luminance relative to each other. In some embodiments, profiling parameters may be used to set different weighting of smoothing and other parameters to allow variation in the strength of luminance control applied to different LED backlight segments 304 of LED backlight panel 194 during display panel assembly operation in order to improve luminance uniformity between different LED backlight segments 304 of the LED backlight panel 194. In this regard, the luminance variation offset varies with the luminance value (i.e., it is not linear) such that the change in luminance variation is not linear over the range of zero to maximum luminance. Thus, in one embodiment luminance compensation adjustment based on the luminance level may employ multiple correction factors for several bands of luminance (e.g., such as at 0%, 20%, 40%, 60%, 80%, and 100% luminance), e.g., by using a different optimal weighting factor for each luminance band.

In one optional embodiment, the disclosed systems and methods may be further implemented to provide dynamic uniformity profiling to alter the backlight luminance uniformity profile of a LCD display panel assembly 125 depending on the type of current displayed content on LCD display panel 196 by utilizing different uniformity profiles that correspond to each different type of displayed content, e.g., according to the current "On Pixel Ratio" (OPR) of displayed content on LCD display panel 196 (which is an average ratio of all the LCD pixels of LCD display panel 196 that are currently "On" according to a current frame of image data stream 136). For example, OPR of 100% means all of the pixels of LCD display panel 196 are full on, while an OPR of 50% may mean that half the pixels of LCD display panel 196 are full on and half of the pixels of LCD display panel 196 are off or that all the pixels of LCD display panel 196 are at 50% on, or any other combination that results in the average OPR of all the pixels of LCD display panel 196 being 50%. In this regard, the current OPR value of a current frame is a common conventional calculation that may be performed by Tcon 165.

Examples of different displayed content on LCD display panel include almost all dark display low luminance display (corresponding to a relatively low OPR) with no high lights, and a predominately high luminance image without low lights (corresponding to a high OPR)). In the case of an image frame content that is displayed with low OPR, the human eye is then more sensitive to smaller changes in luminance. In this optional embodiment, different U-LUT offset value files 183 may be created for different respective uniformity profiles that correspond to different respective defined OPR ranges of displayed frame content by measuring optical (e.g., luminance) data from a LCD display panel assembly 125 of FIG. 8 using the methodology of FIG. 9 (both figures being described further herein).

Figure 9:
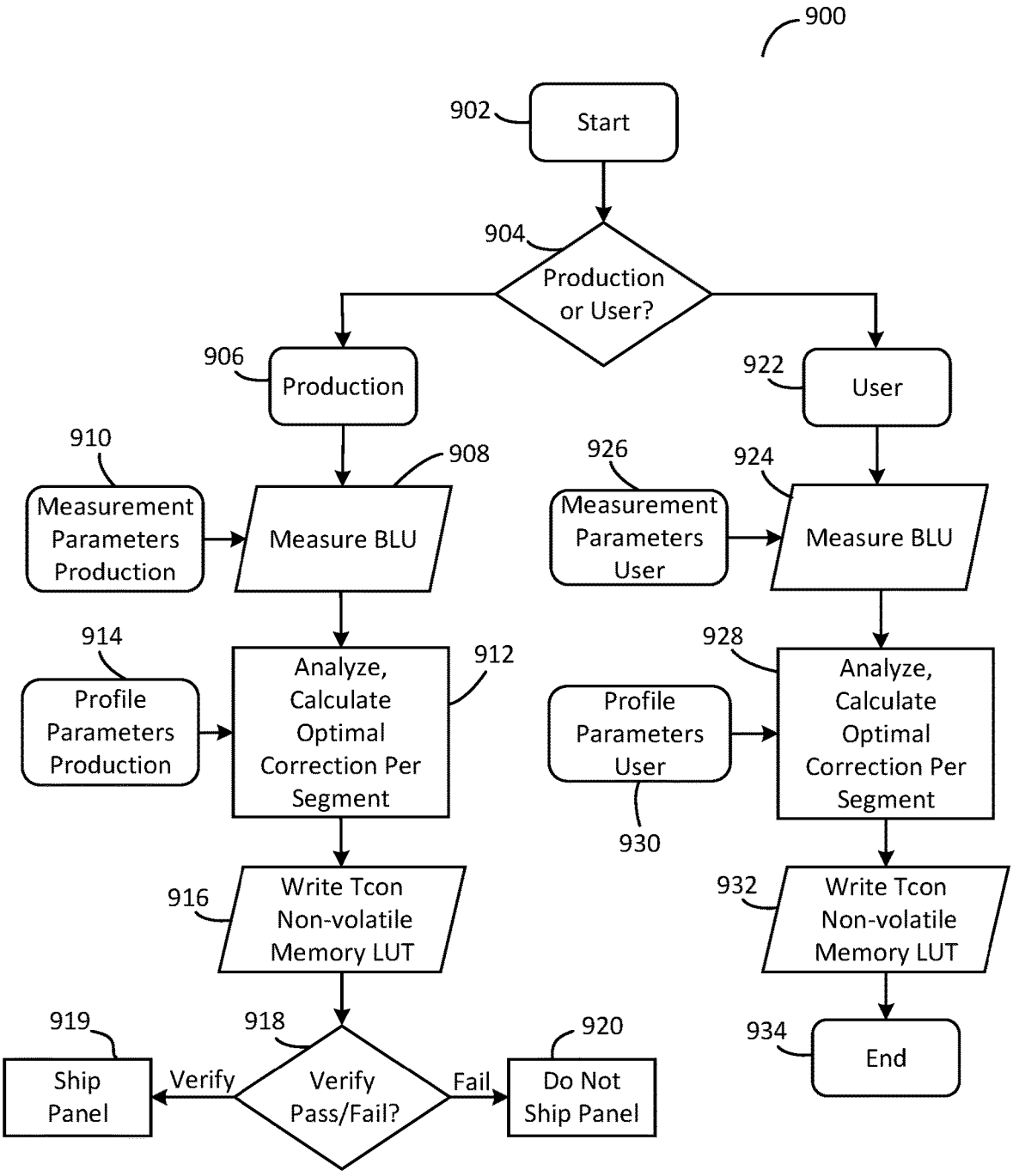
FIG. 9 illustrates a methodology according to one exemplary embodiment of the disclosed systems and methods.

For example, to create a first U-LUT offset value file 183 for use with image frame content that is displayed within a range of 0-20% OPR, measurements may be made in block 908 of FIG. 9 at 0%, 4%, 8%, 12%, 16% and 20% OPR displayed content to calculate and populate a more accurate matrix of offset values for the first U-LUT 183 in block 912 of FIG. 9 that is tailored for use when a displayed content on LCD display panel 196 is currently 0-20% OPR. Additional and different U-LUT offset value files 183 may be similarly created for each 20% increase in OPR (e.g., 21-40% OPR, 41-60% OPR, 61-80% OPR and 81-100% OPR). Then, during later display of each image frame of image data stream 136 (e.g., during normal operation of system 100 and LCD display panel assembly 125 in the field such as described and illustrated herein in relation to FIG. 7), the OPR of the current displayed image frame may be measured or otherwise determined and used to select a U-LUT offset value file 183 of an uniformity profile that corresponds to an OPR range that includes the current OPR of the current displayed image frame such as during blocks 710 and 712 of FIG. 7 (e.g., a U-LUT offset value file 183 for 21-40% may be selected for controlling LED backlighting for a current displayed image frame having a determined OPR of 32%). This selected U-LUT offset value file 183 may then be employed (e.g., during blocks 714, 716 and 718) to alter the uniformity profile of the LED backlight panel 194 of LCD display panel assembly 125.

As an example, multiple different U-LUTs 183 may be provided that have different offset values from each other, and that are each stored in non-volatile memory 183 of Tcon 165. In such an embodiment, each different U-LUT 183 may be provided to match a different uniformity profile. For example, a first U-LUT 183 that includes the illustrated combination of hypothetical scale factors (e.g., including a scale factor of 0.92 in U-LUT segment $504_1$) of the matrix of FIG. 5B may be assigned to correspond to a first uniformity profile, and at least one additional and different combination of hypothetical scale factors (e.g., including a different scale factor of 0.97 in U-LUT segment $\mathbf{504}_1$) may be provided in in a second and different matrix of a second and different U-LUT 183 that is assigned to correspond to a second and different uniformity profile. In such an embodiment, either the first U-LUT 183 of the first uniformity profile or the second U-LUT of the second profile may be selected by the Tcon 165 for use by the Tcon 165 during a current display session based on the identified content that is currently displayed.

Figure 7:
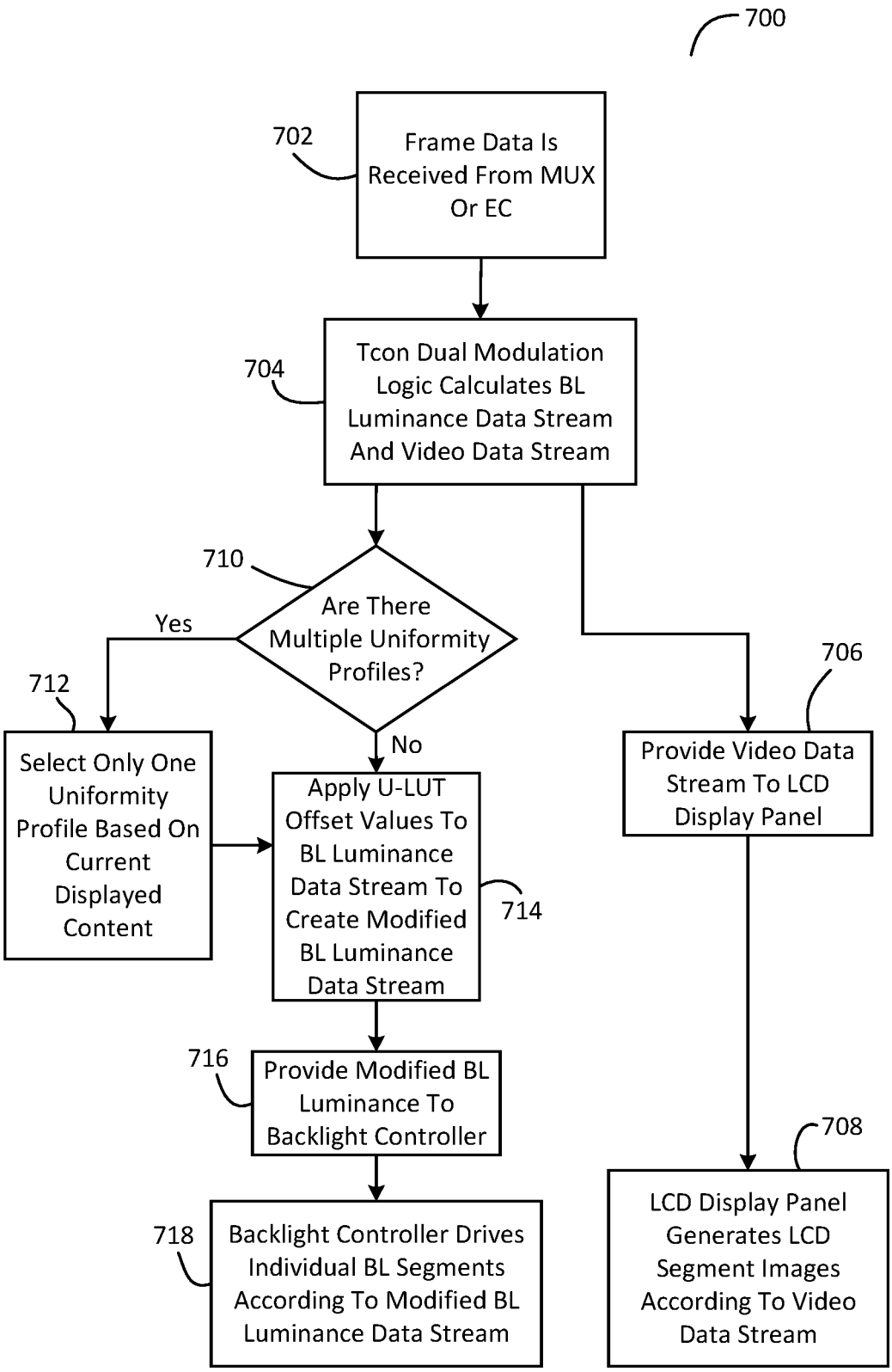
FIG. 7 illustrates a methodology according to one exemplary embodiment of the disclosed systems and methods.

FIG. 7 illustrates methodology 700 that may be employed (e.g., and successively repeated for each displayed image frame of image data stream 136) during normal operation of system 100 in the field to control backlight luminance uniformity of LED backlight panel 194 while simultaneously controlling LCD display panel 196 to generate images that are synchronized with the controlled backlight luminance. Methodology 700 begins in block 702 where frames of image content data 117 is received from MUX 111 or EC 103. In block 704 Tcon 165 executes dual modulation logic 155 to calculate or otherwise generate original backlight luminance data stream 131 and image data stream 136. As shown in block 706 of FIG. 7, Tcon 165 provides image data stream 136 to LCD display panel 196, and in block 708 each segment 404 of LCD display panel 196 generates an image according to image data stream 136.

If Tcon non-volatile memory 183 contains multiple uniformity profiles in block 710, then Tcon 165 selects only one of the uniformity profiles (and its corresponding single U-LUT 183) in block 712 based on the characteristic/s (e.g., OPR of displayed frame content) of the current displayed content of a frame of image data stream 136 and proceeds to block 714. If Tcon non-volatile memory 183 does not contain multiple uniformity profiles (i.e., there is only a single U-LUT 183 stored in Tcon non-volatile memory 183), then methodology 700 selects the single U-LUT 183 and proceeds directly to block 714.

In block 714, Tcon 165 applies the offset values of the selected U-LUT 183 to the original backlight luminance data stream 131 to create modified backlight luminance data stream 133 in a manner as previously described herein. In block 716, Tcon 165 then provides modified backlight luminance data stream 133 to backlight controller 185. Backlight controller 185 in turn uses modified backlight luminance data stream 133 in block 718 to generate and provide backlight driver signals 137 to LED backlight panel 194 to individually control brightness levels of different backlight segments 304 of LED backlight panel 194 to illuminate corresponding segments 404 of LCD display panel 196 which are simultaneously displaying images based on the corresponding image data stream 136, i.e., which is synchronized with the LED backlight brightness levels produced according to backlight driver signals 137.

Figure 8:
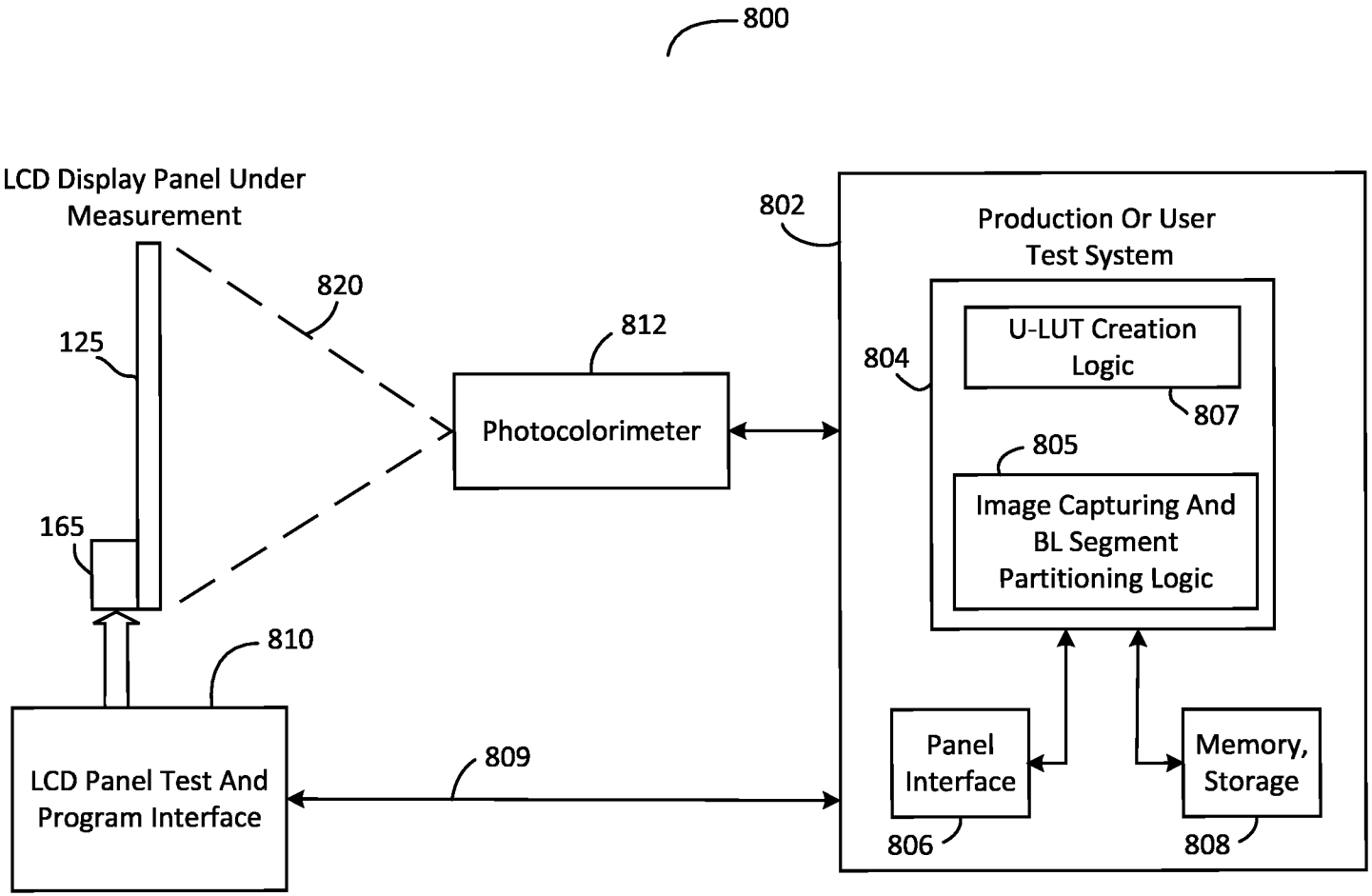
FIG. 8 illustrates a block diagram of an LCD display panel test configuration according to one exemplary embodiment of the disclosed systems and methods.

FIG. 8 illustrates an LCD display panel test configuration 800 that includes a test system 802 that may be employed in one embodiment to use measured optical data obtained from a LCD display panel assembly 125 to populate a uniformity look up table (U-LUT) 183 of Tcon 165 of the display panel assembly 125 with a matrix of offset values (e.g., such as the exemplary offset values illustrated in FIG. 5B). In one exemplary embodiment, test configuration 800 may be implemented in a system production (e.g., factory) environment during manufacture of display panel assembly 125, or during manufacture of an information handling system 100 that includes display panel assembly 125. In such a production environment embodiment, test system 802 may be a single programmable test and programming final control test station. In another embodiment, test configuration 800 may be implemented after manufacture of display panel assembly 125 (e.g., in the field), for example by an end user of LCD display panel assembly 125 or an information handling system 100 that includes LCD display panel assembly 125. In such a user embodiment, test system 802 may be an end user information handling system, e.g., such as desktop, laptop or tablet computer, etc.

As shown in FIG. 8, test system 802 may include a host programmable integrated circuit 804 which may be a central processing unit CPU such as an Intel processor, Advanced Micro Devices (AMD) processor, or one of many other suitable programmable integrated circuits currently available. Host programmable integrated circuit 804 may be coupled as shown to system memory and storage components 808, e.g., solid state drive or hard drive storage that may store programming for logic executed by host programmable integrated circuit 804, volatile memory such as DRAM or SDRAM that may be used to load logic programming for execution by that may store programming for logic executed by host programmable integrated circuit 804, etc.

As further shown in FIG. 8, host programmable integrated circuit 804 of test system 802 may be communicatively coupled by a panel interface 806 to a LCD display panel test and program interface 810 that is in turn communicatively coupled to components of LCD display panel assembly 125 (including Tcon 165), and that may include a user interface such as a displayed graphical user interface (GUI) for receiving selections and commands from a production user or end user who is conducting measurement of LCD display panel assembly 125 to create a corresponding U-LUT for Tcon 165. Interfaces 806 and 810 operate together to, among other things, communicate signals 809 from host programmable integrated circuit 804 to LCD display panel assembly 125 (e.g., such as control signals for operating LCD display panel assembly 125, U-LUT programming signals for programming and storing data in Tcon non-volatile memory 186 of LCD display panel assembly 125, etc.). Also shown in FIG. 8, is a photocolorimeter 812 (e.g., such as Konica CA-410 available from Konica Minolta of Chiyoda, Japan) which may be positioned to capture (and measure characteristics of) emitted light and displayed images 820 from LCD display panel assembly 125. Photocolorimeter 812 includes an internal programmable integrated circuit (e.g., microcontroller) that is programmed to perform the functions thereof, and may also be communicatively coupled as shown to receive control signals from, and provide measurement data signals to, test system 802.

As shown in FIG. 8, host programmable integrated circuit 804 of test system 802 may be programmed to execute image capture and backlight segment partitioning logic 805 (e.g., software such as Radiant Texture Mura available from Radiant Vision Systems of Redmond, Wash.), and U-LUT creation logic 807. Tasks that may be performed by image capture and backlight segment partitioning logic 805 include, but are not limited to, turning on LCD display panel assembly 125, setting appropriate images displayed by LCD display panel assembly 125 for measurement. measuring luminance of LCD display panel assembly 125, and partitioning panel data for each segment area of LCD display panel assembly 125. Tasks that may be performed by U-LUT creation logic 807 include, but are not limited to, generating U-LUT correction data or offset values, and writing the correction data to a U-LUT 183 stored in NVM 186 of Tcon 165.

It will be understood that FIG. 8 is exemplary only. For example, in another embodiment, backlight luminance compensation logic may be executed as separate uniformity compensation logic by a programmable integrated circuit of LED backlight controller 185 for a display panel assembly. In such an alternative embodiment, a segmented LED backlight panel 194 and its LED backlight controller 185 may be tested and programmed for luminance uniformity as a separate unit from the remaining portions of LCD display panel assembly 125 and its integrated Tcon 165.

FIG. 9 illustrates methodology 900 that may be employed in one embodiment (e.g., by the LCD display panel test configuration 800 of FIG. 8 that includes test system 802) to measure optical (e.g., luminance) data from a LCD display panel assembly 125 of FIG. 8, and to calculate and populate a U-LUT 183 of Tcon 165 of the display panel assembly 125 with a matrix of offset values. Methodology 900 may be executed, for example, by image capturing and backlight segment partitioning logic 805 and U-LUT creation logic 804, and starts in block 902. Methodology then proceeds to block 904, where it is determined whether methodology is being implemented in a production (e.g., manufacturing facility) environment or by an end user in the field, e.g., based on selection made by a production or end user input to LCD panel.

If methodology 900 is being executed in a production environment, then methodology 900 proceeds to a production branch of methodology 900 that begins in block 906 and then proceeds to block 908 where LED backlight measurements are made using photocolorimeter 812 by image capturing and backlight segment partitioning logic 805. Measurement parameters (e.g., such as the physical value of the LCD display panel 196 and the segmented backlight panel 194 that are taken from a mechanical drawing of the panel and showing the location of the viewable area of the LCD display panel 196, the location and size of each of the backlight segments areas 194, etc.) may be provided (e.g., from the panel specification and required calculation supported for the panel design) to image capturing and backlight segment partitioning logic 805 in block 910 for use during the measurement tasks performed in block 908. Image capturing and backlight segment partitioning logic 805 (e.g., photocolorimeter software) may use this measurement parameter data to define each backlight segment 304 as an independent area of interest, and to calculate different values such as luminance uniformity in a variety of different ways and using any suitable mathematical definition, e.g., by considering measured luminance of each LED backlight segment 304 independently, by considering together the measured luminance of any specified group of LED backlight segments 304 that is less than all the LED backlight segments 304, by considering together the measured luminance of all LED backlight segments 304, etc. Examples of image capturing and backlight segment partitioning logic (e.g., software) 805 include, but are not limited to, TrueTest and TrueMura available from Radiant Vision Systems of Redmond, Wash., etc.

In one embodiment of block 908, each of the individual local dimming LED backlight segments 304 may be tuned to a suitable luminance optimized for best optical or operational performance (e.g., according to specified parameters such as to provide best uniformity in the most eye sensitive luminance levels, to provide lowest power consumption, etc.). Each LED backlight segment 304 may then be independently measured in block 908 by photocolorimeter 812 (or similar device) for luminance accuracy.

In one embodiment of block 908, all of the LED backlight segments 304 may be driven and measured at one time, in which case all of the LED backlight segments 304 may be turned on together, and a measurement image of all backlight segments 304 of the entire LED backlight panel 194 may be taken simultaneously. During block 908, image capturing and backlight segment partitioning logic 805 and photocolorimeter 812 may utilize program mapping (e.g., taking a picture of the entire display area of LCD display panel assembly 125 and dividing this picture into segments that correspond to the individual LED backlight segments 304) to identify and report the luminance performance value of each individual LED backlight segment 304 to image capturing and backlight segment partitioning logic 805. The measured luminance values may be provided from photocolorimeter 812 in a matrix that corresponds in a 1:1 relationship to the matrix of segments 504 of U-LUT 183, i.e., so that the measured luminance value of each given LED backlight segment 304 is reported in a matrix position that corresponds to the position of the given LED backlight segment 304 in the LED backlight segment matrix of LED backlight panel 194. This reported luminance performance data of each LED backlight segment 304 may then be provided or otherwise made available (e.g., directly from photocolorimeter 812 or from memory/storage 808 of system 802) to U-LUT creation logic 807).

Next, in block 912, U-LUT creation logic 807 may analyze and process the reported luminance performance data from block 908 of each individual LED backlight segment 304 from block 910 to determine (e.g., calculate) a correction factor (e.g., offset value) for that individual LED backlight segment 304. In one embodiment, profile parameters (e.g., that specify the type and order of measurement tests of block 908 are being performed for offset value calculation) may be provided (e.g., from the panel specification and required calculation supported for the panel design) or otherwise accessed in block 914, and used in block 912 for purposes of defining which and how luminance profiles are to be calculated, and the method/s to calculate the U-LUT 183 prior to storing it in memory in preparation for block 916. In this regard, different types of display panel assemblies 125 have different orders of matrix for their LED backlight segments 304, and therefore different profile parameters may be provided for different respective orders of matrix for LED backlight segments 304.

After a correction factor (e.g., offset value) for each of the individual LED backlight segments 304 is determined in block 912, it may be written in block 916 by U-LUT creation logic 807 to the corresponding segment address location 504 of U-LUT 183 that is stored in NVM 186 of Tcon 165, e.g., so as to populate the U-LUT 183 with writes to the corresponding respective U-LUT segment locations 504. Then in block 918, pass/fail verification is performed to verify the results of previous blocks of methodology 900 for shipping purposes against specified limits. For example, a pass/fail verification may be applied to the created U-LUT 183 by performing a uniformity calculation for the U-LUT 183. In one embodiment, the calculated uniformity must pass a predefined uniformity limit or threshold to "pass", otherwise it "fails". After block 918, methodology 900 of FIG. 9 successfully completes and LCD display panel assembly 125 is shipped in block 919 with system 100 only if a "pass" occurs in block 918 (otherwise, methodology 900 terminates in block 920 and the LCD display panel assembly 125 is not approved for shipment with system 100, and is therefore not shipped).

In a further embodiment, an initial measurement may also be performed prior to the creation of the U-LUT 183 to provide a "before" test measurement of panel uniformity, and a comparison may be made in block 918 between the calculated uniformity of the created U-LUT 183 to the "before" test uniformity measurement values. If the difference between the calculated uniformity of the created U-LUT 183 to the "before" test uniformity measurement values is greater than a defined uniformity difference threshold, then the verification of block 918 fails since there may be other issues with the LCD display panel assembly 125 under test. Other tests that may be performed during pass/fail verify block 918 include, but are not limited to, measuring power consumption of LCD display panel assembly 125 before and after correction by U-LUT 183 to ensure that the U-LUT-corrected LCD display panel assembly 125 has a power consumption that is not greater than the power consumption of the uncorrected LCD display panel assembly 125 by more than a defined threshold amount of additional power. A "failure" occurs if the U-LUT-corrected LCD display panel assembly 125 has an increased power consumption that is greater than the defined threshold amount of additional power.

Returning to block 904, if it is determined in block 904 that methodology 900 is being implemented by an end user in the field (e.g., after system manufacture and shipment with LCD display panel assembly 125), then methodology 900 proceeds to a user branch of methodology 900 that begins in block 922 and then proceeds to blocks 924, 926, 928, 930 and 932, which are performed in the same manner as described herein for production process blocks 908, 910, 912, 914 and 916, respectively. In the user branch of methodology 900, user-approved or user-specified measurement parameters of block 926 may be the same or different than the production measurement parameters of block 910, and user-approved or user-specified profile parameters of block 930 may be the same or different than the production profile parameters of block 914. In the user branch, methodology 900 terminates in block 934 after writing a determined correction factor (e.g., offset value) from block 928 for each of the individual LED backlight segments 304 to the corresponding segment address location 504 of U-LUT 183 that is stored in NVM 186 of Tcon 165, e.g., so as to populate the U-LUT 183 with writes to the corresponding respective U-LUT segment locations 504. Although the tasks of pass/fail verification block 918 may be missing from the user branch of methodology 900, it will be understand that an end user may optionally employ their own selected technique and/or metrics after block 932 to verify the results of previous user branch blocks of methodology 900 (e.g. against user-specified limits) to determine whether the results of user branch blocks of methodology 900 should be accepted for future operation of display panel assembly 125, or should instead be rejected in which case the user may either repeat the user branch blocks of methodology 900 (e.g., using different user-specified measurement parameters and/or user-specified profile parameter) or return the LED backlight luminance settings to default values.

Figure 10:
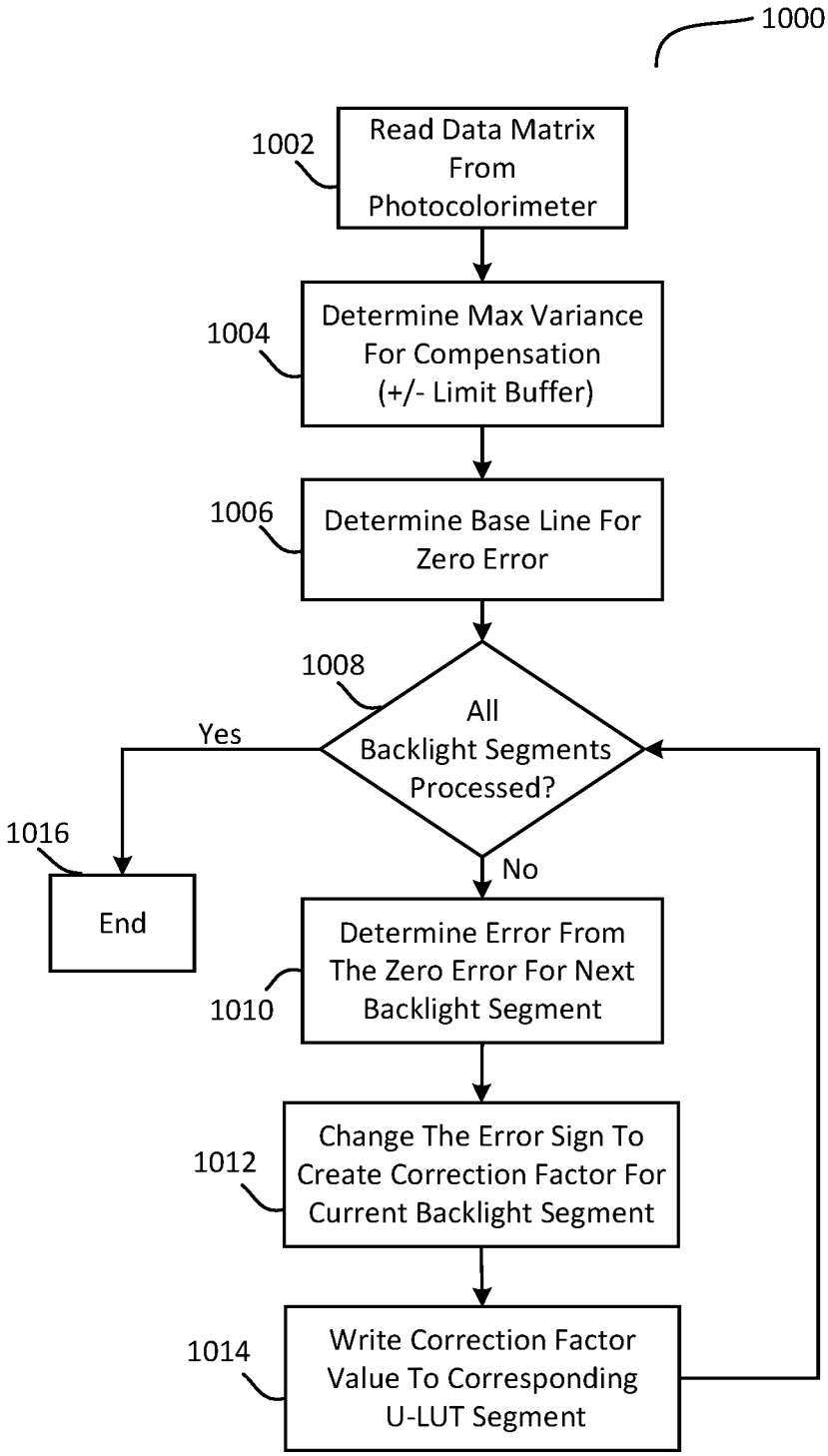
FIG. 10 illustrates a methodology according to one exemplary embodiment of the disclosed systems and methods.

FIG. 10 illustrates one exemplary embodiment of a methodology 1000 that may be implemented by U-LUT creation logic 807 to perform the tasks of blocks 912 and 916. As shown, methodology 1000 begins in block 1002 where U-LUT creation logic 807 reads the luminance performance data matrix (e.g., directly from photocolorimeter 812 or from memory/storage 808 of system 802). Then in block 1004, U-LUT creation logic 807 determines the maximum variance for luminance compensation (e.g., the difference between the maximum measured luminance data value in the photocolorimeter luminance data matrix and the minimum measured luminance data value in the photocolorimeter luminance data matrix). This variation may be used to set the "+" and "−" buffer limits in memory 808 for processing of the luminance data. In block 1006, U-LUT creation logic 807 determines a LED backlight luminance value base line from the data of the photocolorimeter luminance data matrix. This determined luminance value base line may then be used as a zero error value for calculating the correction factor (e.g., offset value) for each of the individual LED backlight segments 304.

In one embodiment, a LED backlight luminance value base line may be determined by averaging the luminance level of all of the backlight segments 304. However, in one exemplary embodiment, prior to calculating the luminance value base line in block 1006, an additional correction may first be made based on a comparison of the measured LED backlight luminance value to the expected luminance value specified by the test code used by test system 802 in FIG. 10.

To illustrate, assume that image capture and backlight segment partitioning logic 805 of test system 802 sends data code values that specify to LED backlight panel 194 that all LED backlight segments 304 are to be set at a luminance value of 100 nits. The luminance of all the LED backlight segments 304 may then be measured, and the actual average luminance of all the LED backlight segments 304 of panel 194 may then be calculated from the actual measured LED backlight segment luminance. Ideally, in this example, this calculated average luminance of all the LED backlight segments 304 should be 100 nits, which matches the expected luminance specified in this example by backlight segment partitioning logic 805.

However, the calculated actual average luminance of the LED backlight panel 194 under test may in some cases differ from the specified panel luminance value by a given luminance difference value which may be calculated by image capture and backlight segment partitioning logic 805 (e.g., in this example the actual calculated average luminance of the LED backlight panel 194 may be more or less than 100 nits, with the luminance difference value being the positive or negative difference between the calculated actual average luminance of all segments of the LED backlight panel 194 and the specified panel luminance value provided from test system 802). Image capture and backlight segment partitioning logic 805 may calculate this luminance difference value and use it to correct the specified LED backlight luminance value for all the LED backlight segments 304 to determine a corrected LED backlight luminance value base line in block 1006 for the LED backlight panel 194 under test.

To illustrate, assuming in this example that the calculated actual average luminance of all segments of the LED backlight panel 194 is 95 nits, then the calculated luminance difference value would be −5 nits (95 nits−100 nits), and the specified LED backlight luminance value for all the LED backlight segments 304 would be corrected by adding 5 nits to the specified 100 nit LED backlight luminance value for all the LED backlight segments 304 to determine in block 1006 a corrected LED backlight luminance value base line value of 105 nits that is specified for all the LED backlight segments 304 of LED backlight panel 194. On the other hand, assuming in this example that the calculated actual average luminance of all segments of the LED backlight panel 194 is 103 nits, then the calculated luminance difference value would be +3 nits (103 nits−100 nits), and the specified LED backlight luminance value for all the LED backlight segments 304 would be corrected by subtracting 3 nits from the specified 100 nit LED backlight luminance value for all the LED backlight segments 304 to determine in block 1006 a corrected LED backlight luminance value base line value of 97 nits that is specified for all the LED backlight segments 304 of LED backlight panel 194.

Next, in block 1008, methodology 900 enters an iterative phase in which a correction factor (e.g., offset value) is calculated for each LED backlight segment 304, and written to its corresponding U-LUT matrix segment 504 of U-LUT 183. This begins in the block 1008 where it is determined whether a correction factor has been previously determined for all LED backlight segments 304. If not, then methodology 900 proceeds to block 1010, where a segment error value (e.g., variance from the determined zero error reference value or LED backlight luminance value base line of block 1006) is calculated for the next unprocessed LED backlight segment 304, e.g., according to a predefined order that proceeds systematically through the matrix of LED backlight segments 304 one-by-one until a correction factor has been calculated for all LED backlight segments 304. In 1012, the sign (i.e., + or −) of the calculated segment error value for the current LED backlight segment 304 is changed or reversed (i.e., to − or +, respectively) to create a correction factor (e.g., offset value) for the current LED backlight segment 304.

Next, the correction factor for the current LED backlight segment 304 that was created in block 1012 is then written by U-LUT creation logic 807 into the corresponding U-LUT matrix segment 504 stored in NVM 186 of Tcon 165. Methodology 900 then returns to block 1008, and blocks 1010 to 1014 are repeated for the next unprocessed LED backlight segment 304. When measured data corresponding to all LED backlight segments 304 has been processed (i.e., respective correction factors have been determined for all current LED backlight segments 304), then the answer in block 1008 is "Yes", and methodology 900 ends in block 1016. The U-LUT 183 stored in NVM 186 of Tcon 165 of the LCD display panel assembly 125 is then ready for deployment and use in the field by an end user, It will understood that the particular combination of actions of the methodologies of each of FIGS. 7, 9 and 10 are exemplary only, and that other combinations of these or other actions may be employed that are suitable for performing the function of the particular methodology.

It will also be understood that one or more of the tasks, functions, or methodologies described herein (e.g., including those described herein for components 103, 105, 110, 120, 133, 165, 804, 805, 807, 812, etc.) may be implemented by circuitry and/or by a computer program of instructions (e.g., computer readable code such as firmware code or software code) embodied in a non-transitory tangible computer readable medium (e.g., optical disk, magnetic disk, non-volatile memory device, etc.), in which the computer program includes instructions that are configured when executed on a processing device in the form of a programmable integrated circuit (e.g., processor such as CPU, controller, microcontroller, microprocessor, ASIC, etc. or programmable logic device "PLD" such as FPGA, complex programmable logic device "CPLD", etc.) to perform one or more steps of the methodologies disclosed herein. In one embodiment, a group of such processing devices may be selected from the group consisting of CPU, controller, microcontroller, microprocessor, FPGA, CPLD and ASIC. The computer program of instructions may include an ordered listing of executable instructions for implementing logical functions in an processing system or component thereof. The executable instructions may include a plurality of code segments operable to instruct components of an processing system to perform the methodologies disclosed herein.

It will also be understood that one or more steps of the present methodologies may be employed in one or more code segments of the computer program. For example, a code segment executed by the information handling system may include one or more steps of the disclosed methodologies. It will be understood that a processing device may be configured to execute or otherwise be programmed with software, firmware, logic, and/or other program instructions stored in one or more non-transitory tangible computer-readable mediums (e.g., data storage devices, flash memories, random update memories, read only memories, programmable memory devices, reprogrammable storage devices, hard drives, floppy disks, DVDs, CD-ROMs, and/or any other tangible data storage mediums) to perform the operations, tasks, functions, or actions described herein for the disclosed embodiments.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touch screen and/or a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A method, comprising:

providing image content data to a display panel assembly, the display panel assembly including a display panel and a backlight panel that comprises multiple backlight elements illuminating the display panel;

responding to receipt of the image content data in the display panel assembly by producing image data and backlight luminance data from the image content data;

modifying the backlight luminance data using at least one correction factor to produce a modified backlight luminance data;

adjusting image modulation data of the image data based on the modified backlight luminance data;

simultaneously providing the image data to the display panel and providing the modified backlight luminance data to the backlight panel; and generating an image on the display panel from the image data while at the same time using the modified backlight luminance data to control a luminance level of light emitted to the display panel from each of the backlight elements.

2. The method of claim 1, where the backlight panel is a segmented backlight panel that includes an array of the multiple backlight elements that is segmented into a matrix of multiple backlight segments that each include one or more of the backlight elements, the backlight elements of each backlight segment being different from the backlight elements of all other backlight segments of the backlight panel; where the at least one correction factor comprises offset value data that includes multiple different offset values, each of the different offset values being assigned to a respective different one of the multiple different backlight segments; and where the method further comprises:

producing the backlight luminance data from the image content data as separate modified backlight luminance data for each of the different backlight segments;

producing the modified backlight luminance data by modifying the separate backlight luminance data for each given one of the different backlight segments using a respective offset value that is assigned to the given backlight segment;

simultaneously providing the image data to the display panel and providing the separate modified backlight luminance data for each given one of the different backlight segments to the respective corresponding given backlight segment; and generating the image on the display panel from the image data while at the same time using the separate modified backlight luminance data for each given one of the different backlight segments to control a luminance level of light emitted to the display panel from the given one of the different backlight segments.

3. The method of claim 2, where the display panel is segmented into multiple display areas that each displays images based on the image content, each of the multiple display areas being aligned to receive light from a different and corresponding one of the multiple backlight segments of the backlight panel; and where the generating the image further comprises generating a different portion of the image on each given one of the multiple display areas of the display panel from the image data while at the same time using the separate modified backlight luminance data for each given one of the different backlight segments to control a luminance level of light emitted to a display area that corresponds to the given one of the different backlight segments.

4. The method of claim 2, where the display panel is segmented into multiple display areas that each displays images based on the image content, each of the multiple display areas being aligned to receive light from a different and corresponding one of the multiple backlight segments of the backlight panel; and where the generating the image further comprises generating a different portion of the image on each given one of the multiple display areas of the display panel from the image data while at the same time using the separate modified backlight luminance data for each given one of the different backlight segments to control a luminance level of light emitted to the display area that corresponds to the given one of the different backlight segments such that the luminance level of light emitted to a display area that corresponds to the given one of the different backlight segments is different from a luminance level of light emitted to at least one other display area that corresponds to another backlight segment.

5. The method of claim 2, where the offset value data is provided by a lookup table comprising a matrix of multiple entries corresponding to the matrix of multiple backlight segments of the segmented backlight panel, each of the entries of the lookup table containing a respective offset value assigned to a corresponding one of the multiple backlight segments.

6. The method of claim 2, where the offset value data comprises multiple different correction factors corresponding to different backlight luminance levels occurring during operation of the display panel assembly; and where the modifying the backlight luminance data using the at least one correction factor to produce a modified backlight luminance data is based on the luminance level during operation of the display panel assembly.

7. The method of claim 1, further comprising:

providing the image content data from a graphics processing unit (GPU) to a timing controller (Tcon) of the display panel assembly;

responding to receipt of the image content data in the Tcon by producing image data and backlight luminance data from the image content data;

executing the Tcon or a backlight controller of the display panel assembly to retrieve the at least one correction factor from a non-volatile memory of the display panel assembly;

executing the Tcon or a backlight controller of the display panel assembly to use the retrieved at least one correction factor to modify the backlight luminance data to produce the modified backlight luminance data; and simultaneously providing the image data from the Tcon to the display panel and executing the backlight controller to use the modified backlight luminance data to control the luminance level of the light emitted to the display panel from each of the backlight elements.

8. The method of claim 7, further comprising replacing or updating at least a first correction factor stored in the non-volatile memory with a different second correction factor reprogrammed by an end user after display panel assembly manufacture and shipment, and prior to performing the modifying the backlight luminance data using the second correction factor to produce the modified backlight luminance data.

9. The method of claim 7, where the at least one correction factor comprises offset value data; where the modifying the backlight luminance data further comprises selecting the offset value data from a uniformity profile stored in the non-volatile memory; and where the method further comprises downloading updates and dynamically modifying the uniformity profile stored in the non-volatile memory after deployment of a display panel assembly.

10. The method of claim 1, where the display panel is a liquid crystal (LCD) display panel; and where the backlight panel is a light emitting diode (LED) backlight panel.

11. The method of claim 1, further comprising:

measuring luminance performance data of a displayed image of the display panel assembly;

using the measured luminance performance data to determine the at least one correction factor for modifying luminance of the multiple backlight elements of the display panel assembly during operation of the display panel assembly; and writing the determined at least one correction factor to non-volatile memory of the display panel assembly.

12. The method of claim 11, where the backlight panel is a segmented backlight panel that includes an array of the multiple backlight elements that is segmented into a matrix of multiple backlight segments that each include one or more of the backlight elements, the backlight elements of each backlight segment being different from the backlight elements of all other backlight segments of the backlight panel; and where the determining the at least one the correction factor comprises determining offset value data that includes multiple different offset values, each of the different offset values being assigned to a respective different one of the multiple different backlight segments.

13. The method of claim 12, where the offset value data comprises a lookup table comprising a matrix of multiple entries corresponding to the matrix of multiple backlight segments of the segmented backlight panel, each of the entries of the lookup table containing a respective offset value assigned to a corresponding one of the multiple backlight segments.

14. A method, comprising:

providing image content data to a display panel assembly, the display panel assembly including a display panel and a backlight panel that comprises multiple backlight elements illuminating the display panel;

responding to receipt of the image content data in the display panel assembly by producing image data and backlight luminance data from the image content data;

modifying the backlight luminance data using at least one correction factor to produce a modified backlight luminance data;

simultaneously providing the image data to the display panel and providing the modified backlight luminance data to the backlight panel; and generating an image on the display panel from the image data while at the same time using the modified backlight luminance data to control a luminance level of light emitted to the display panel from each of the backlight elements;

where the method further comprises:

measuring luminance performance data of a displayed image of the display panel assembly, using the measured luminance performance data to determine the at least one correction factor for modifying luminance of the multiple backlight elements of the display panel assembly during operation of the display panel assembly, and writing the determined at least one correction factor to non-volatile memory of the display panel assembly;

where the backlight panel is a segmented backlight panel that includes an array of the multiple backlight elements that is segmented into a matrix of multiple backlight segments that each include one or more of the backlight elements, the backlight elements of each backlight segment being different from the backlight elements of all other backlight segments of the backlight panel; and where the determining the at least one the correction factor comprises determining offset value data that includes multiple different offset values, each of the different offset values being assigned to a respective different one of the multiple different backlight segments;

where the offset value data comprises a lookup table comprising a matrix of multiple entries corresponding to the matrix of multiple backlight segments of the segmented backlight panel, each of the entries of the lookup table containing a respective offset value assigned to a corresponding one of the multiple backlight segments; and where determining the offset value data that includes the multiple different offset values comprises:

measuring luminance performance data of each of the multiple backlight segments of the matrix of multiple backlight elements, determining a backlight luminance value base line from the measured luminance performance data, the backlight luminance value base line being an average of the measured average luminance level of all the multiple backlight segments, and determining a respective offset value for each of the multiple backlight segments, the respective offset value for each given one of the multiple backlight segments being a difference between the measured luminance level of the given backlight segment and the determined backlight luminance value base line.

15. A method, comprising:

providing image content data to a display panel assembly, the display panel assembly including a display panel and a backlight panel that comprises multiple backlight elements illuminating the display panel;

responding to receipt of the image content data in the display panel assembly by producing image data and backlight luminance data from the image content data;

modifying the backlight luminance data using at least one correction factor to produce a modified backlight luminance data;

simultaneously providing the image data to the display panel and providing the modified backlight luminance data to the backlight panel;

generating an image on the display panel from the image data while at the same time using the modified backlight luminance data to control a luminance level of light emitted to the display panel from each of the backlight elements;

where the backlight panel is a segmented backlight panel that includes an array of the multiple backlight elements that is segmented into a matrix of multiple backlight segments that each include one or more of the backlight elements, the backlight elements of each backlight segment being different from the backlight elements of all other backlight segments of the backlight panel;

where the at least one correction factor comprises offset value data that includes multiple different offset values, each of the different offset values being assigned to a respective different one of the multiple different backlight segments; and where the method further comprises:

producing the backlight luminance data from the image content data as separate modified backlight luminance data for each of the different backlight segments, producing the modified backlight luminance data by modifying the separate backlight luminance data for each given one of the different backlight segments using a respective offset value that is assigned to the given backlight segment, simultaneously providing the image data to the display panel and providing the separate modified backlight luminance data for each given one of the different backlight segments to the respective corresponding given backlight segment, and generating the image on the display panel from the image data while at the same time using the separate modified backlight luminance data for each given one of the different backlight segments to control a luminance level of light emitted to the display panel from the given one of the different backlight segments;

where the modifying the backlight luminance data further comprises selecting the offset value data to be a first offset value data corresponding to a first uniformity profile from multiple available offset value data.

16. The method of claim 15, where the multiple available offset value data comprises multiple different uniformity profiles that correspond to different types of displayed content; where the first uniformity profile corresponds to a first type of displayed content that is different from the type of displayed content of the other uniformity profiles of the multiple different uniformity profiles; and where the selecting the offset value data to be the first offset value data further comprises determining that the type of displayed content of the image currently generated on the display panel is the first type of displayed content, and then selecting the first offset data value from the first uniformity profile that corresponds to the first type of displayed content.

17. The method of claim 16, where the different types of displayed content each correspond to a different range of On Pixel Ratio (OPR) value of displayed content; where the first uniformity profile corresponds to a first OPR value range that is different from the OPR value range of each of the other different uniformity profiles of the multiple different uniformity profiles; and where the selecting the offset value data to be the first offset value data further comprises:

measuring the OPR value of the displayed content of the image currently generated on the display panel;

determining that the measured OPR value of the displayed content of the image currently generated on the display panel corresponds to the first OPR value range; and then selecting the first offset data value from the first uniformity profile that corresponds to the first OPR value range.

18. A system, comprising:

a display panel assembly comprising a display panel, a backlight panel that comprises multiple backlight elements illuminating the display panel, and at least one first programmable integrated circuit programmed to receive image content data;

where the at least one first programmable integrated circuit of the display panel assembly is programmed to:

respond to receipt of the image content data by producing image data and backlight luminance data from the image content data, modify the backlight luminance data using at least one correction factor to produce modified backlight luminance data, adjust image modulation data of the image data based on the modified backlight luminance data, simultaneously provide the image data to the display panel and provide the modified backlight luminance data to the backlight panel; and generate an image on the display panel from the image data while at the same time using the modified backlight luminance data to control a luminance level of light emitted to the display panel from each of the backlight elements.

19. The system of claim 18, where the backlight panel is a segmented backlight panel that includes an array of the multiple backlight elements that is segmented into a matrix of multiple backlight segments that each include one or more of the backlight elements, the backlight elements of each backlight segment being different from the backlight elements of all other backlight segments of the backlight panel; where the at least one correction factor comprises offset value data that includes multiple different offset values, each of the different offset values being assigned to a respective different one of the multiple different backlight segments; and where the at least one first programmable integrated circuit of the display panel assembly is programmed to:

produce the backlight luminance data from the image content data as separate modified backlight luminance data for each of the different backlight segments, produce the modified backlight luminance data by modifying the separate backlight luminance data for each given one of the different backlight segments using a respective offset value that is assigned to the given backlight segment, simultaneously provide the image data to the display panel and provide the separate modified backlight luminance data for each given one of the different backlight segments to the respective corresponding given backlight segment, and generate the image on the display panel from the image data while at the same time using the separate modified backlight luminance data for each given one of the different backlight segments to control a luminance level of light emitted to the display panel from the given one of the different backlight segments.

20. The system of claim 19, where the offset value data comprises multiple different correction factors corresponding to different backlight luminance levels during operation of the display panel assembly.

21. The system of claim 19, further comprising non-volatile memory coupled to the at least one first programmable integrated circuit, the non-volatile memory storing the offset value data as at least one lookup table comprising a matrix of multiple entries corresponding to the matrix of multiple backlight segments of the segmented backlight panel, each of the entries of the lookup table containing a respective offset value assigned to a corresponding one of the multiple backlight segments; and where the at least one first programmable integrated circuit is programmed to retrieve the at least one lookup table from the non-volatile memory.

22. The system of claim 21, further comprising at least one second programmable integrated circuit external to the display panel assembly that is coupled to the display panel assembly and programmed to provide the image content data to the at least one first programmable integrated circuit of the display panel assembly.

23. The system of claim 22, where the at least one second programmable integrated circuit comprises a central processing unit (CPU), graphics processing unit (GPU), or embedded controller (EC) of an information handling system; where the at least one first programmable integrated circuit of the display panel assembly comprises a timing controller (Tcon) and a backlight controller of the display panel assembly; and where:

the Tcon is programmed to respond to receipt of the image content data in the Tcon by producing image data and backlight luminance data from the image content data; and the Tcon or backlight controller is programmed to retrieve the offset value data from the non-volatile memory of the display panel assembly and to use the retrieved offset value data to modify the backlight luminance data to produce the modified backlight luminance data.

24. The system of claim 18, where the display panel is a liquid crystal (LCD) display panel; and where the backlight panel is a light emitting diode (LED) backlight panel.

* * * * *